US008032064B2

(12) United States Patent
Yamada et al.

(10) Patent No.: US 8,032,064 B2
(45) Date of Patent: Oct. 4, 2011

(54) DEVELOPER APPARATUS, IMAGE FORMING APPARATUS AND DEVELOPING METHOD

(75) Inventors: Yoichi Yamada, Shiojiri (JP); Takatomo Fukumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 388 days.

(21) Appl. No.: 12/252,261

(22) Filed: Oct. 15, 2008

(65) Prior Publication Data

US 2009/0110443 A1 Apr. 30, 2009

(30) Foreign Application Priority Data

Oct. 26, 2007 (JP) ..... 2007-278968
Aug. 8, 2008 (JP) ..... 2008-205119

(51) Int. Cl.
*G03G 15/08* (2006.01)

(52) U.S. Cl. ..... 399/284; 399/254

(58) Field of Classification Search ..... 399/254, 399/179, 284
See application file for complete search history.

(56) References Cited

U.S. PATENT DOCUMENTS 4,780,741 A 10/1988 Wada et al.
5,286,918 A 2/1994 Iwata et al.
5,424,814 A 6/1995 Suzuki et al.
5,502,552 A 3/1996 Iwata et al.
5,805,966 A 9/1998 Yamada
7,018,761 B2 3/2006 Yamanouchi et al.
7,366,434 B2 4/2008 Ream et al.
7,565,099 B2 7/2009 Yamada et al.
2001/0005461 A1* 6/2001 Ichikawa et al. ..... 399/281
2002/0003974 A1* 1/2002 Nittani et al. ..... 399/284
2004/0126692 A1 7/2004 Yamanouchi et al.
2004/0213603 A1* 10/2004 Shigeta et al. ..... 399/254
2005/0095037 A1 5/2005 Koike et al.
2007/0110481 A1 5/2007 Yamada et al.
2007/0110484 A1 5/2007 Yamada et al.
2007/0201907 A1 8/2007 Baba et al.
2008/0273901 A1 11/2008 Toyama et al.

(Continued)

FOREIGN PATENT DOCUMENTS

EP 1 998 229 A1 12/2008

(Continued)

OTHER PUBLICATIONS

European Search Report for corresponding European application No. 08018679.4-1240. Cited references filed on Dec. 10, 2007.

(Continued)

*Primary Examiner* — David Gray
*Assistant Examiner* — G. M. Hyder
(74) *Attorney, Agent, or Firm* — DLA Piper LLP (US)

(57) ABSTRACT

A developer apparatus, includes: a container which houses toner; a toner carrier roller that is provided, on a surface thereof, with a plurality of convex sections which are regularly arranged and a concave section which surrounds the convex sections, is shaped approximately like a cylinder, and rotates while carrying a toner layer of charged toner supplied from the container on the surface thereof, and a restriction member that abuts on the surface of the toner carrier roller to form a restriction nip, restricts a thickness of the toner layer carried on the surface of the toner carrier roller in the restriction nip, and removes the toner layer on the convex sections from among the toner layer carried on the surface of the toner carrier roller at an upstream-side end of the restriction nip in a rotation direction of the toner carrier roller.

17 Claims, 13 Drawing Sheets

U.S. PATENT DOCUMENTS

| | | | | |
|---|---|---|---|---|
| 2008/0298853 | A1* | 12/2008 | Yamada et al. | 399/279 |
| 2009/0110428 | A1* | 4/2009 | Yamada | 399/99 |
| 2009/0110444 | A1* | 4/2009 | Yamada et al. | 399/284 |
| 2009/0110445 | A1* | 4/2009 | Yamada | 399/284 |
| 2009/0148197 | A1* | 6/2009 | Yamada et al. | 399/284 |
| 2010/0239326 | A1* | 9/2010 | Yamada et al. | 399/284 |
| 2010/0239327 | A1* | 9/2010 | Yamada et al. | 399/284 |

FOREIGN PATENT DOCUMENTS

| | | | |
|---|---|---|---|
| GB | 2 120 960 | A | 12/1983 |
| JP | 06-138774 | | 5/1994 |
| JP | 2003-057940 | | 2/2003 |
| JP | 2007-121948 | | 5/2007 |
| JP | 2007-121949 | A | 5/2007 |
| JP | 2007-121950 | | 5/2007 |
| JP | 2007-127800 | | 5/2007 |
| JP | 2007-140080 | | 6/2007 |
| JP | 2007147853 | A | 6/2007 |

OTHER PUBLICATIONS

U.S. office action dated Dec. 27, 2010 for related U.S. Appl. No. 12/254,646.

* cited by examiner

DEVELOPER APPARATUS, IMAGE FORMING APPARATUS AND DEVELOPING METHOD

CROSS REFERENCE TO RELATED APPLICATION

The disclosure of Japanese Patent Applications No. 2007-278968 filed on Oct. 26, 2007 and No. 2008-205119 filed on Aug. 8, 2008 including specification, drawings and claims is incorporated herein by reference in its entirety.

BACKGROUND

1. Technical Field

The present invention relates to a developer apparatus which comprises a toner carrier roller which carries toner on a surface thereof, an image forming apparatus and a developing method of developing an electrostatic latent image with toner using this roller.

2. Related Art

Techniques for developing an electrostatic latent image with toner include an apparatus which causes a surface of a toner carrier roller to carry toner, the toner carrier roller being shaped approximately like a cylinder. For the purpose of improving the characteristics of toner carried on the surface of such a toner carrier roller, the applicant of the present application has earlier disclosed a structure of a toner carrier roller having a cylindrical shape that the surface of the roller includes convex sections which are regularly arranged and a concave section which surrounds the convex sections (JP-A-2007-127800). Since the concavo-convex patterns in the surface are regulated and uniform, such a structure is advantageous in that it permits easy control of the thickness of a toner layer which is carried on the surface of the roller, the charge level and the like.

SUMMARY

However, in the case where a toner carrier roller having the structure above is used, owing to the evenness of the convexo-concave, scattering of toner from the surface of the toner carrier roller, fog and the like will be a problem unless a toner layer thickness on the toner carrier roller is strictly controlled. According to research by the inventors of the invention, one of the primary causes of these phenomena appears to be that when old toner whose characteristics have degraded in accordance with use is present together with new toner having excellent characteristics, the old toner tends to be carried particularly in a far layer from the surface of the toner carrier roller. In a toner layer far from the surface of the toner carrier roller, adhesion of toner to the toner carrier roller is weak. Hence, it is considered that leakage and scattering of toner and fog are easy to occur.

An advantage of some aspects of the invention is to provide technology for reducing leakage and scattering of toner from a toner carrier roller, fog and the like in a developer apparatus, an image forming apparatus and a developing method which use a toner carrier roller whose surface is provided with convexoconcave.

According to a first aspect of the invention, there is provided a developer apparatus, comprising: a container which houses toner; a toner carrier roller that is provided, on a surface thereof, with a plurality of convex sections which are regularly arranged and a concave section which surrounds the convex sections, is shaped approximately like a cylinder, and rotates while carrying a toner layer of charged toner supplied from the container on the surface thereof; and a restriction member that abuts on the surface of the toner carrier roller to form a restriction nip, restricts a thickness of the toner layer carried on the surface of the toner carrier roller in the restriction nip, and removes the toner layer on the convex sections from among the toner layer carried on the surface of the toner carrier roller at an upstream-side end of the restriction nip in a rotation direction of the toner carrier roller.

According to a second aspect of the invention, there is provided an image forming apparatus, comprising: an image carrier that carries an electrostatic latent image; and a developer that includes a toner carrier roller which is provided, on a surface thereof, with a plurality of convex sections which are regularly arranged and a concave section which surrounds the convex sections, is shaped approximately like a cylinder, and carries a toner layer of charged toner on the surface thereof, the developer developing the electrostatic latent image carried by the image carrier with the toner, wherein within the surface of the toner carrier roller, after the convex sections and the concave section have carried the toner layer, a restriction member abutting on the surface of the toner carrier roller removes the toner layer on the convex sections.

According to a third aspect of the invention, there is provided a developing method, comprising: arranging a toner carrier roller opposed to an image carrier which carries an electrostatic latent image, the toner carrier roller being provided, on a surface thereof, with a plurality of convex sections which are regularly arranged and a concave section which surrounds the convex sections, being shaped approximately like a cylinder, and carrying a toner layer of charged toner on the surface thereof; developing the electrostatic latent image with the toner; causing the convex sections and the concave section within the surface of the toner carrier roller to carry the toner layer before the arranging the toner carrier roller carrying the toner layer opposed to the image carrier; and removing the toner layer on the convex sections by means of a restriction member abutting on the surface of the toner carrier roller.

The findings of the inventors of the invention based on various experiments, although will be described in detail later, will now be described briefly. Of toner carried by the surface of a toner carrier roller, new toner having excellent characteristics (hereinafter referred to as "new toner") gathers near the surface of the toner carrier roller, whereas toner whose characteristics have degraded with long use (hereinafter referred to as "old toner") is contained in concentrated amounts in toner which is on top of the new toner and which is carried as it is separated from the surface of the toner carrier roller. In other words, a toner layer made mainly of new toner is formed first on the surface of the toner carrier roller, and another toner layer containing a big amount of old toner is formed on the surface of the previous toner layer. Such old toner, owing to its reduced contact with the toner carrier roller, is not charged sufficiently, and hence, may leak, scatter or cause fog.

Noting this, the invention uses a structure that from among toner layers formed on the surface of the toner carrier roller, a restriction member removes a toner layer which is on the convex sections of the toner carrier roller. In this structure, of toner thus removed from the convex sections, new toner having a high charge level pushes away old toner which is carried by the concave section, has a low charge level and adheres to the toner carrier roller with weak electrostatic suction force. As this lowers the proportion of the old toner contained in thus restricted toner layers, it is possible to suppress toner scattering, fog and the like.

When a pressure is applied to old toner having a low charge level, toner particles may clump together, forming an aggregate having a large diameter and a low charge level, and this aggregate may leak out to outside the developer apparatus. However, according to the invention, since it is only the concave section within the surface of the toner carrier roller that carries toner, toner carried by the concave section is free from the pressure applied by the restriction member. This makes it difficult for toner to clump together to form an aggregate and this makes it possible to suppress degradation of toner itself, which is effective in discouraging scattering of toner to outside the developer apparatus.

According to a fourth aspect of the invention, there is provided a developer apparatus, comprising: a container which houses toner; a toner carrier roller which is shaped approximately like a cylinder, is provided, on a surface thereof, with a plurality of convex sections which are regularly arranged and a concave section which surrounds the convex sections, and rotates while carrying a toner layer of charged toner supplied from the container on the surface thereof, a height difference between the convex sections and the concave section being equal to or larger than twice a volume average particle diameter of toner; and a restriction member which abuts on the surface of the toner carrier roller to remove a toner layer on the convex sections from among the toner layer carried on the surface of the toner carrier roller.

According to a fifth aspect of the invention, there is provided an image forming apparatus, comprising: an image carrier that carries an electrostatic latent image; and a developer that includes a toner carrier roller and a restriction member, and develops the electrostatic latent image carried by the image carrier with toner, the toner carrier roller being provided, on a surface thereof, with a plurality of convex sections which are regularly arranged and a concave section which surrounds the convex sections, being shaped approximately like a cylinder, and carrying a toner layer of charged toner on the surface thereof, the restriction member abutting on the surface of the toner carrier roller to remove a toner layer on the convex sections from among the toner layer carried on the surface of the toner carrier roller, a height difference between the convex sections and the concave section being equal to or larger than twice a volume average particle diameter of toner.

According to the invention having the structure above, since the restriction member removes toner which is on the convex sections within the surface of the toner carrier roller, it is possible to suppress leakage, scattering and the like of toner having an insufficient charge level as in the developer apparatus described above. Meanwhile, it is possible for the concave section of the toner carrier roller to carry two or more layers of toner. For this reason, there is such toner which is carried by the concave section but is not in direct contact with the surface of the toner carrier roller. Making such toner carried by the toner carrier roller, the invention attains a better development efficiency during development of an electrostatic latent image.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIGS. 6A through 6D are diagrams showing a model for describing a mechanism of toner scattering and the like.

DESCRIPTION OF EXEMPLARY EMBODIMENTS

Figure 1:
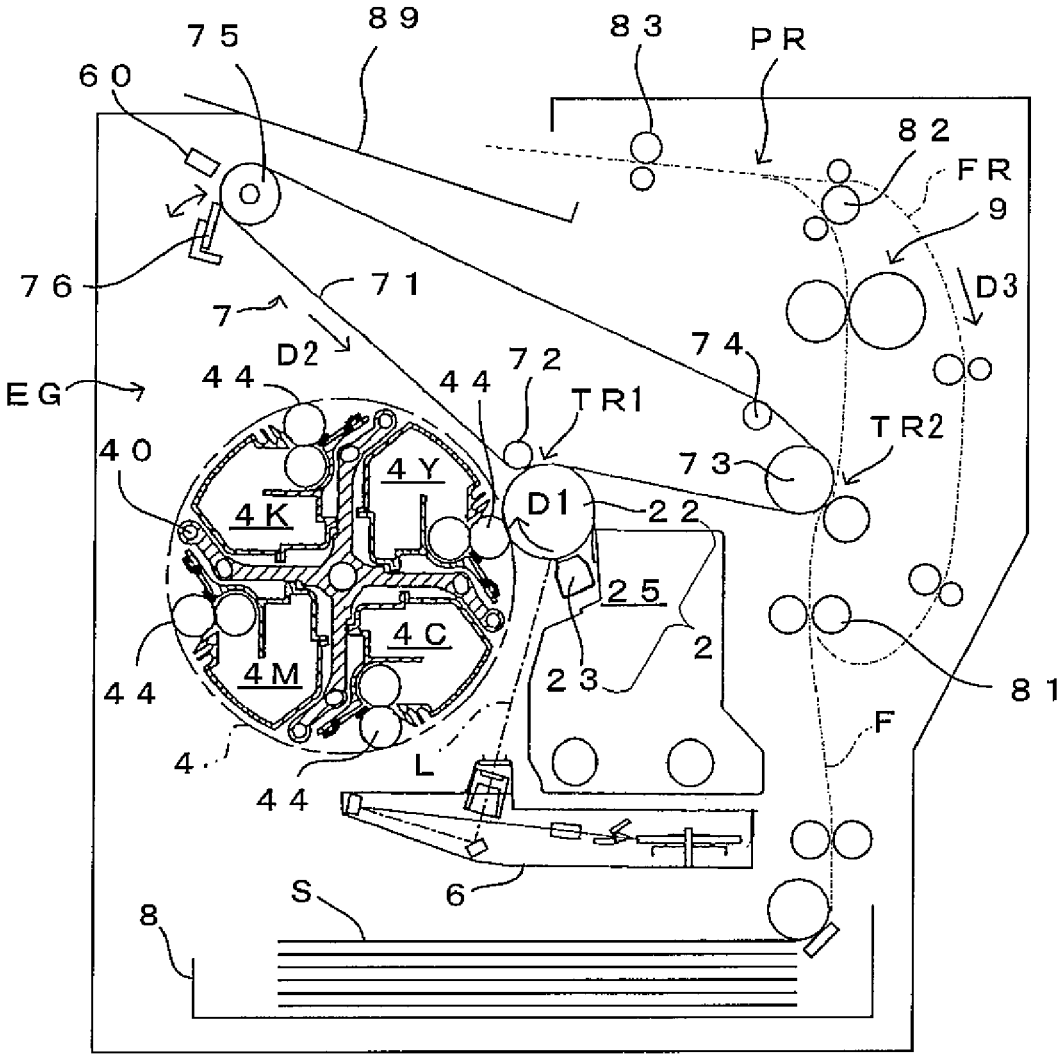
FIG. 1 is a diagram showing a first embodiment of an image forming apparatus according to the invention.
Figure 2:
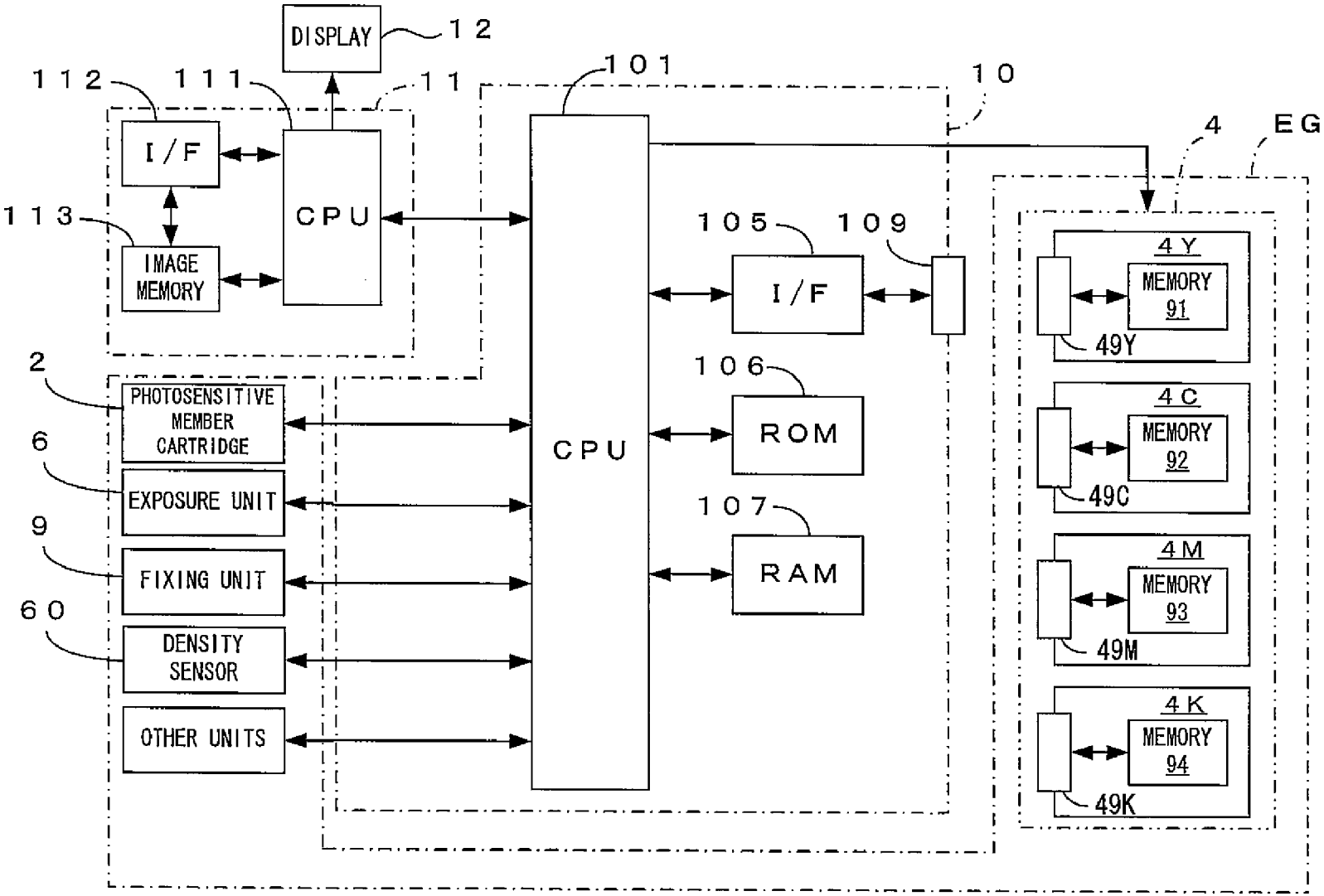
FIG. 2 is a block diagram of an electric structure of the image forming apparatus which is shown in FIG. 1.

FIG. 1 is a diagram showing a first embodiment of an image forming apparatus according to the invention. FIG. 2 is a block diagram of an electric structure of the image forming apparatus which is shown in FIG. 1. This apparatus is an image forming apparatus which overlays toner in four colors of yellow (Y), cyan (C), magenta (M) and black (K) one atop the other and accordingly forms a full-color image, or forms a monochrome image using only black toner (K). In the image forming apparatus, when an image signal is fed to a main controller 11 from an external apparatus such as a host computer, a CPU 101 provided in an engine controller 10 controls respective portions of an engine part EG in accordance with an instruction received from the main controller 11 to perform a predetermined image forming operation, and accordingly, an image which corresponds to the image signal is formed on a sheet S.

In the engine part EG, a photosensitive member 22 is disposed so that the photosensitive member 22 can freely rotate in an arrow direction D1 shown in FIG. 1. Around the photosensitive member 22, a charger unit 23, a rotary developer unit 4 and a cleaner 25 are disposed in the rotation direction D1. A predetermined charging bias is applied upon the charger unit 23, whereby an outer circumferential surface of the photosensitive member 22 is charged uniformly to a predetermined surface potential. The cleaner 25 removes toner which remains adhering to the surface of the photosensitive member 22 after primary transfer, and collects the toner into a waste toner tank which is disposed inside the cleaner 25. The photosensitive member 22, the charger unit 23 and the cleaner 25, integrated as one, form a photosensitive member cartridge 2. The photosensitive member cartridge 2 can be freely attached to and detached from an apparatus main body as one integrated unit.

An exposure unit 6 emits a light beam L toward the outer circumferential surface of the photosensitive member 22 charged by the charger unit 23. This exposure unit 6 exposes the photosensitive member 22 by the light beam L in accordance with the image signal given from the external apparatus to form an electrostatic latent image corresponding to the image signal.

The developer unit 4 develops thus formed electrostatic latent image with toner. Specifically, the developer unit 4 includes a support frame 40 which is provided rotatable about a rotation shaft orthogonal to a plane of FIG. 1 and a yellow developer 4Y, a cyan developer 4C, a magenta developer 4M and a black developer 4K which are freely attachable to and detachable from the support frame 40 and house toner of the respective colors. An engine controller 10 controls the developer unit 4. The developer unit 4 is driven into rotation based on a control instruction from the engine controller 10. When the developers 4Y, 4C, 4M and 4K are selectively positioned at a predetermined developing position which abuts on the photosensitive member 22 or is faced with the photosensitive member 22 over a predetermined gap, the developing roller 44 which is disposed in this developer and carries a toner of a selected color is positioned facing the photosensitive member 22, and the developing roller 44 supplies the toner onto the surface of the photosensitive member 22 at the facing position. As a result, the electrostatic latent image on the photosensitive member 22 is visualized with the toner of the selected color.

Figure 3:
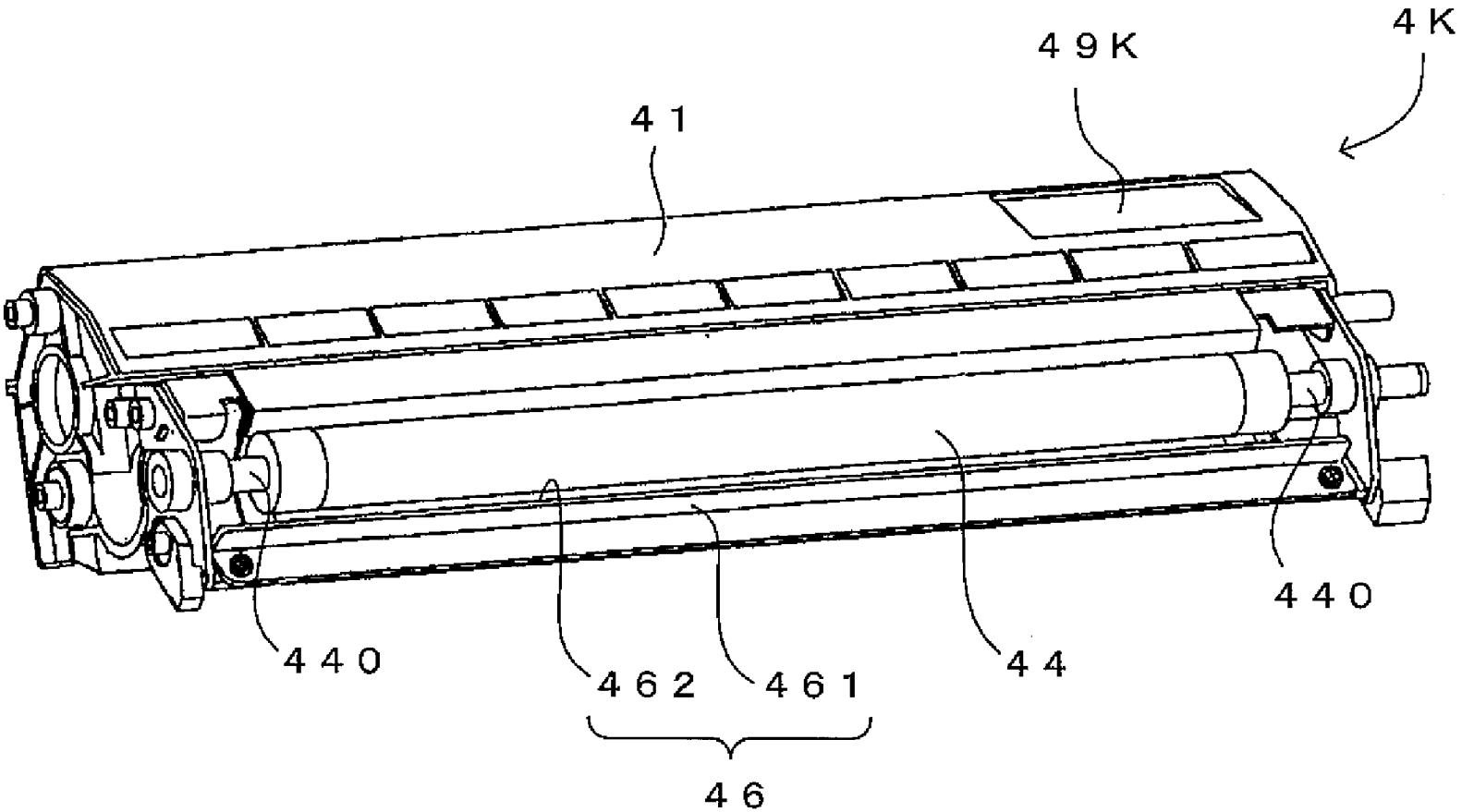
FIG. 3 is a diagram showing the appearance of the developer.
Figure 4:
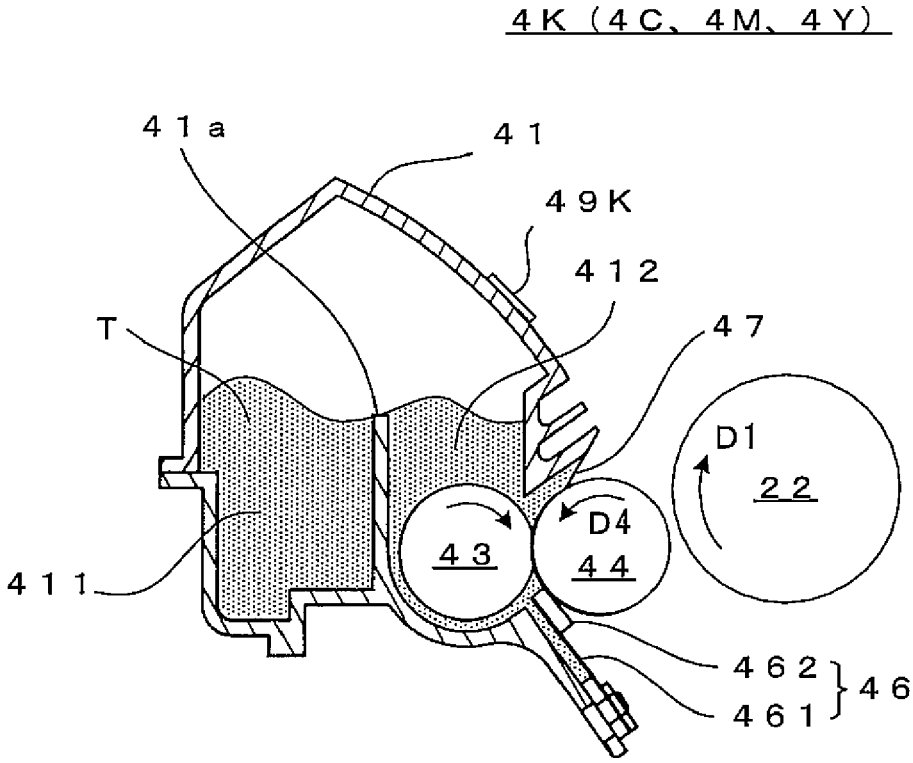
FIG. 4 is a cross sectional view showing a structure of the developer.

FIG. 3 is a diagram showing the appearance of the developer. FIG. 4 is a cross sectional view showing a structure of the developer. The developers 4Y, 4C, 4M and 4K have identical structures. Therefore, the structure of the developer 4K will now be described in further detail with reference to FIGS. 3 and 4. The other developers 4Y, 4C and 4M have the same structures and functions, to be noted. In the developer 4K, a feed roller 43 and a developing roller 44 are rotatably attached with a shaft to a housing 41 which houses toner T inside. When the developer 4K is positioned at the developing position described above, the developing roller 44 is positioned at a facing position which abuts on the photosensitive member 22 or is faced with the photosensitive member 22 over a predetermined gap, and these rollers 43 and 44 are engaged with a rotation driver (not shown) which is provided in the main body to rotate in a predetermined direction. The feed roller 43 is shaped like a cylinder and is made of an elastic material such as foamed urethane rubber and silicone rubber. The developing roller 44 is shaped like a cylinder and is made of metal or alloy such as copper, aluminum and stainless steel. The two rollers 43 and 44 rotate while staying in contact with each other, and accordingly, the toner is rubbed against the surface of the developing roller 44 and a toner layer having a predetermined thickness is formed on the surface of the developing roller 44. Although negatively-charged toner is used in this embodiment, positively-charged toner may be used instead.

The space inside the housing 41 is divided by a partition wall 41*a* into a first chamber 411 and a second chamber 412. The feed roller 43 and the developing roller 44 are both provided in the second chamber 412. With a rotation of these rollers, toner within the second chamber 412 flows and is fed to the surface of the developing roller 44 while getting agitated. Meanwhile toner stored inside the first chamber 411 would not be moved by the rotation since it is isolated from the feed roller 43 and the developing roller 44. This toner is mixed with toner stored in the second chamber 412 and is agitated by the rotation of the developer unit 4 while holding the developer.

As described above, in this developer, the inside of the housing is separated into the two chambers, and the side walls of the housing 41 and the partition wall 41*a* surround the feed roller 43 and the developing roller 44, and accordingly, the second chamber 412 of relatively small volume is provided. Therefore, even when a remaining toner amount is small, toner is supplied efficiently to near the developing roller 44. Further, supply of toner from the first chamber 411 to the second chamber 412 and agitation of the whole toner are performed by the rotation of the developer unit 4. Hence, an auger-less structure is realized that an agitator member (auger) for agitating toner is not provided inside the developer.

Further, in the developer 4K, a restriction blade 46 is disposed which restricts the thickness of the toner layer formed on the surface of the developing roller 44 into the predetermined thickness. The restriction blade 46 includes a plate-like member 461 made of elastic material such as stainless steel, phosphor bronze or the like and an elastic member 462 which is attached to a front edge of the plate-like member 461 and is made of a resin member such as silicone rubber and a urethane rubber. A rear edge of the plate-like member 461 is fixed to the housing 41. The elastic member 462 attached to the front edge of the plate-like member 461 is positioned on the upstream side to the rear edge of the plate-like member 461 in a rotation direction D4 of the developing roller 44 shown by an arrow in FIG. 4. The elastic member 462 elastically abuts on the surface of the developing roller 44 to form a restriction nip, thereby restricting the toner layer formed on the surface of the developing roller 44 finally into the predetermined thickness.

The toner layer thus formed on the surface of the developing roller 44 is gradually transported, by the rotation of the developing roller 44, to an opposed position facing the photosensitive member 22 on a surface of which the electrostatic latent image has been formed. When a developing bias from a bias power source not shown is applied upon the developing roller 44, the toner carried on the developing roller 44 partially adheres to respective portions within the surface of the photosensitive member 22 in accordance with a surface potential thereof. The electrostatic latent image on the photosensitive member 22 is visualized as a toner image in this toner color in this manner.

The housing 41 further includes a seal member 47 which is pressed against the surface of the developing roller 44 on the downstream side to the opposed position facing the photosensitive member 22 in the rotation direction of the developing roller 44. The seal member 47 guides toner which remains on the surface of the developing roller 44 after moving past the opposed position facing the photosensitive member 22 to inside the housing 41 and prevents toner inside the housing from leaking to outside.

Figure 5:
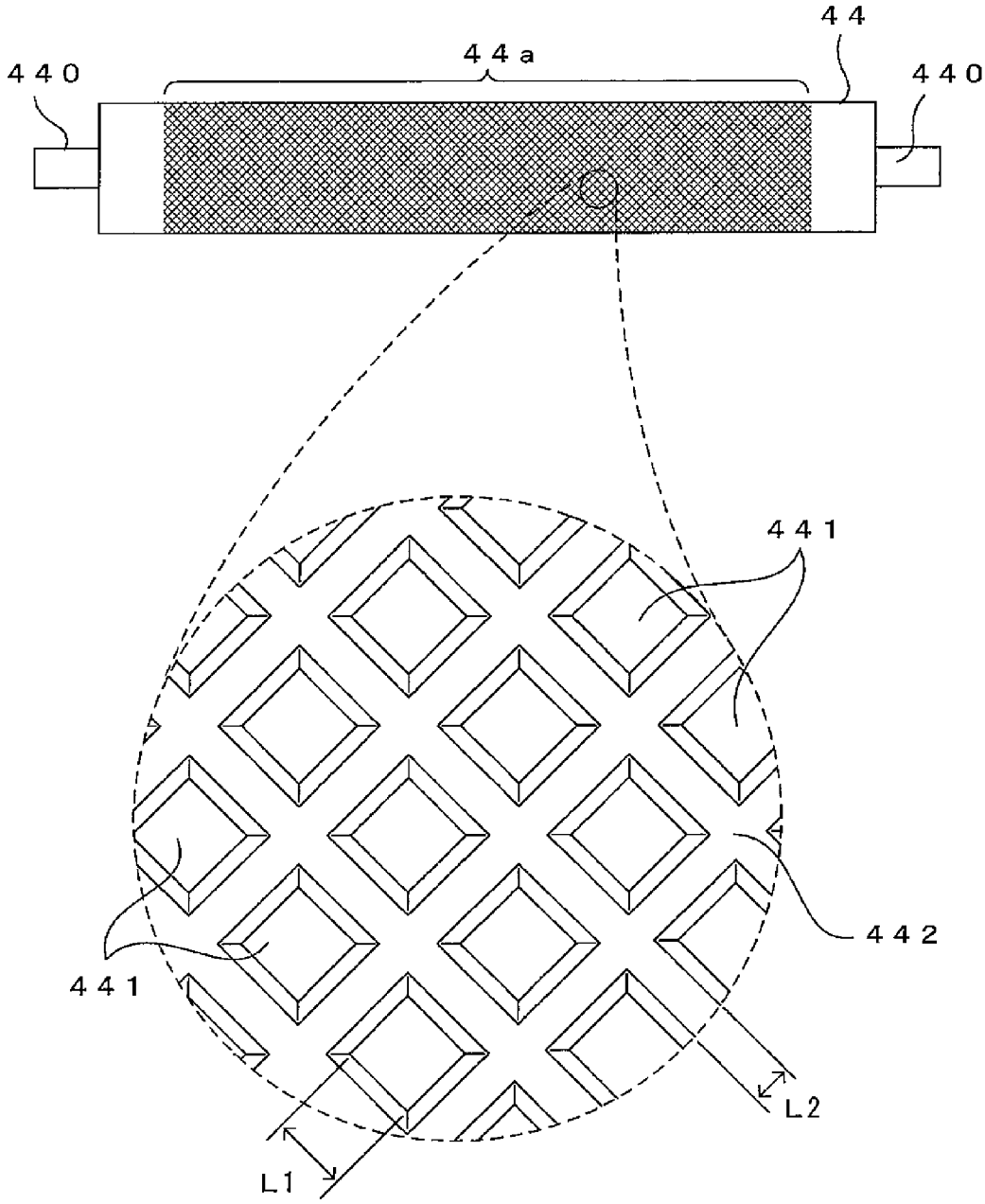
FIG. 5 is a group of diagrams showing a side view of the developing roller and a partially expanded view of the surface of the developing roller.

FIG. 5 is a group of diagrams showing a side view of the developing roller and a partially expanded view of the surface of the developing roller. The developing roller 44 is shaped like an approximately cylindrical roller A shaft 440 is provided at the both ends of the roller in the longitudinal direction of the roller such that the shaft is coaxial with the roller. With the shaft 440 supported by the developer main body, the entire developing roller 44 is freely rotatable. A central area 44*a* in the surface of the developing roller 44, as shown in the partially expanded view in FIG. 5 (inside the dotted-line circle), is provided with a plurality of convex sections 441 which are regularly arranged and a concave section 442 which surrounds the convex sections 441.

Each one of the convex sections 441 projects forward from the plane of FIG. 5, and a top surface of each convex section 441 forms a part of a single cylindrical surface which is coaxial with a rotation shaft of the developing roller 44. The concave section 442 is a continuous groove which surrounds the convex sections 441 like a net. The entire concave section 442 also forms a single cylindrical surface which is different from the cylindrical surface which is made by the convex sections and is coaxial with the rotation shaft of the developing roller 44. The developing roller 44 having such a structure may be made by the manufacturing method described in JP-A-2007-140080 for instance. Each convex section 441 may further be processed so that the top surface thereof becomes flat.

The length L1 of a side of the top surface of each convex section 441 and a distance L2 between the respective convex sections may be but are not limited to 10 through 100 μm approximately for instance. The shape, the arrangement and the like of the convex sections 441 are not limited to those described here. A difference in height between the convex sections 441 and the concave section 442 will be described later.

Referring back to FIG. 1, the description of the image forming apparatus is continued. The toner image developed by the developer unit 4 as described above is primarily transferred onto an intermediate transfer belt 71 of a transfer unit 7 in a primary transfer region TR1. The transfer unit 7 includes the intermediate transfer belt 71 mounted on a plurality of rollers 72 to 75 and a driver (not shown) for driving the roller 73 into rotation to rotate the intermediate transfer belt 71 in a specified rotating direction D2. In the case of transferring a color image onto the sheet S, the toner images of the respective colors formed on the photosensitive member 22 are superimposed on the intermediate transfer belt 71 to form the color image, which is secondarily transferred onto the sheet S dispensed one by one from a cassette 8 and conveyed to a secondary transfer region TR2 along a conveyance path F.

At this time, for the purpose of correctly transferring the image on the intermediate transfer belt 71 onto the sheet S at a predetermined position, the timing of feeding the sheet S into the secondary transfer region TR2 is controlled. To be more specific, there is a gate roller 81 disposed in front of the secondary transfer region TR2 on the transportation path F. The gate roller 81 starts to rotate in accordance with the timing of rotation of the intermediate transfer belt 71, and accordingly, the sheet S is fed into the secondary transfer region TR2 at a predetermined timing.

Further, the sheet S on which the color image is thus formed is transported to a discharge tray 89 which is disposed at a top surface of the apparatus main body via a pre-discharge roller 82 and a discharge roller 83 after the toner image is fixed to the sheet S by a fixing unit 9. Meanwhile, when images are to be formed on the both surfaces of the sheet S, the discharge roller 83 starts rotating in the reverse direction upon arrival of the rear end of the sheet S, which carries the image on its one surface as described above, at a reversing position PR located behind the pre-discharge roller 82, thereby transporting the sheet S in the arrow direction D3 along a reverse transportation path FR. The sheet S is returned back to the transportation path F again before arriving at the gate roller 81. At this time, the surface of the sheet S which abuts on the intermediate transfer belt 71 in the secondary transfer region TR2 and is to receive a transferred image is opposite to the surface which already carries the image. In this fashion, it is possible to form images on the both surfaces of the sheet S.

Further, as shown in FIG. 2, the respective developers 4Y, 4C, 4M and 4K comprise memories 91, 92, 93 and 94 respectively which store data related to the production lot, the use history, the remaining toner amount and the like of the developers. In addition, wireless telecommunication devices 49Y, 49C, 49M and 49K are provided in the developers 4Y, 4C, 4M and 4K, respectively. When necessary, the telecommunication devices selectively perform non-contact data telecommunication with a wireless telecommunication device 109 which is provided in the apparatus main body, whereby data transmission between the CPU 101 and the memories 91 through 94 via the interface 105 is performed to manage various types of information regarding the developers such as management of consumables. Meanwhile, in this embodiment, non-contact data transmission using electromagnetic scheme such as wireless telecommunication is performed. However, the apparatus main body and each developer may be provided with connectors and the like, and the connectors may be engaged mechanically to perform data transmission between each other.

Further, as shown in FIG. 2, the apparatus includes a display 12 which is controlled by a CPU 111 of the main controller 11. The display 12 is formed by a liquid crystal display for instance, and shows predetermined messages which are indicative of operation guidance for a user, a progress in the image forming operation, abnormality in the apparatus, the timing of exchanging any one of the units, and the like in accordance with the control command from the CPU 111.

In FIG. 2, a reference numeral 113 represents an image memory provided in the main controller 11 in order to store the image supplied from the external apparatus, such as a host computer, via the interface 112. A reference numeral 106 represents a ROM for storage of an operation program executed by the CPU 101 and control data used for controlling the engine EG. A reference numeral 107 represents a RAM for temporary storage of operation results given by the CPU 101 and other data.

Further, there is a cleaner 76 in the vicinity of the roller 75. The cleaner 76 moves nearer to and away from the roller 75 driven by an electromagnetic clutch not shown. In a condition that the cleaner 76 is moved nearer to the roller 75, a blade of the cleaner 76 abuts on the surface of the intermediate transfer belt 71 mounted on the roller 75 and scrapes off the toner remaining on and adhering to the outer circumferential surface of the intermediate transfer belt 71 after the secondary transfer.

Furthermore, a density sensor 60 is disposed in the vicinity of the roller 75. The density sensor 60 confronts a surface of the intermediate transfer belt 71 and measures, as needed, the density of the toner image formed on the outer circumferential surface of the intermediate transfer belt 71. Based on the measurement results, the apparatus adjusts the operating conditions of the individual parts thereof that affects the image quality such as a developing bias applied to each developer, the intensity of the exposure beam L, and tone-correction characteristics of the apparatus, for example.

The density sensor 60 is structured to output a signal corresponding to a contrasting density of a region of a predetermined area defined on the intermediate transfer belt 71 using a reflective optical sensor, for example. The CPU 101 is adapted to detect image densities of individual parts of the toner image on the intermediate transfer belt 71 by periodically sampling the output signals from the density sensor 60 while moving the intermediate transfer belt 71 in rotation.

A detailed description will now be given on restriction of toner layers on the developing roller 44 in the developer 4K, . . . of the image forming apparatus having the structure described above. In the developer 4K, . . . of this image forming apparatus, the feed roller 43 abuts on the surface of the developing roller 44 inside the housing 41 which contains toner T as described earlier, and the restriction blade 46 abuts on a toner layer which is on the developing roller at the downstream side in the rotation direction of the developing roller, and accordingly, the thickness of the toner layer which is carried on the surface of the developing roller 44 is regulated. When the thickness is not appropriate, the image forming operation will be influenced. Specifically, when the toner layer is too thin, the amount of toner transported to the opposed position facing the photosensitive member 22 will be a little and a sufficient image density will not be obtained. On the other hand, when the toner layer is too thick, toner may fall off from the surface of the developing roller 44 and leak inside the apparatus, may scatter around from the developing roller 44 as a cloud, and may adhere onto the photosensitive member 22 to cause fog. These phenomena will hereinafter be referred to as "toner scattering and the like".

First, the principle of toner layer restriction in this embodiment will be described. In a condition that a relatively thick toner layer (that is, the thickness being approximately a several times as large as the volume average particle diameter of toner) was formed, the inventors of the invention conducted various experiments upon the causal correlation between the condition of the surface of the developing roller 44 on which the toner layer is formed and toner scattering and the like. As a result, it has become clear that the model below would explain the mechanism of toner scattering and the like.

Figure 6A:
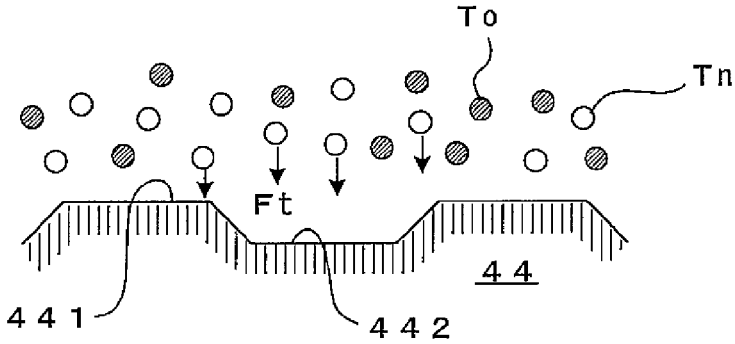

FIGS. 6A through 6D are diagrams showing a model for describing a mechanism of toner scattering and the like. The developer is filled with new toner initially. However, as the image forming operation using the developer is repeatedly executed, the developer contains a mixture of unused toner maintaining its initial characteristics (referred to as "new toner" in the specification) and used toner having degraded characteristics since it has been returned back into inside the developer without being used for development although it was once carried on the surface of the developing roller 44 (referred to as "old toner" in the specification). Hence, there are new toner Tn and old toner To mixed together around the developing roller 44 as shown in FIG. 6A. In FIGS. 6A through 6D, white circles denote the new toner Tn and circles with hatching denote the old toner To.

Figure 6B:
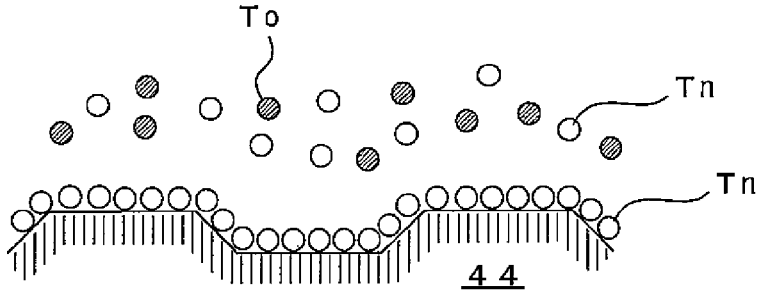

Out of these, new toner Tn, having high fluidity and a high charge level, is attracted toward the surface of the developing roller 44 due to electrostatic force Ft. On the other hand, old toner is inferior to new toner in terms of fluidity and charging characteristics because of burying, separation or the like of an additive, and hence, the power attracted to the developing roller 44 of old toner is weaker than that of new toner. As a result, toner directly contacting the developing roller 44 is mostly new toner Tn as shown in FIG. 6B. In short, of toner layers formed on the surface of the developing roller 44, the first layer which is the closest to the developing roller 44 is made of new toner.

Figure 6C:
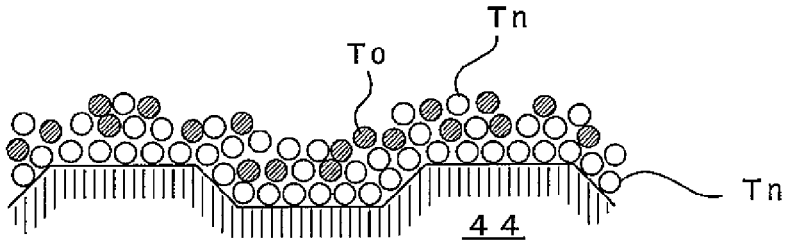

On the other hand, in a layer deposited upon the first layer thus formed, new toner Tn and old toner To are mixed together as shown in FIG. 6C. This is because coating of the surface of the developing roller 44 with a layer of new toner weakens the influence of the electrostatic force of the developing roller itself upon a layer over the new toner layer, and the electric charge of new toner attracts other toner, and hence, attracts not only new toner but also old toner which has a lower charge level or is charged to the opposite polarity due to deterioration. In this specification, the phenomenon that new toner is concentrated inside a layer near the surface of the developing roller 44, whereas a layer far from this surface contains a lot of old toner will be referred to as "layer separation phenomenon".

Figure 6D:
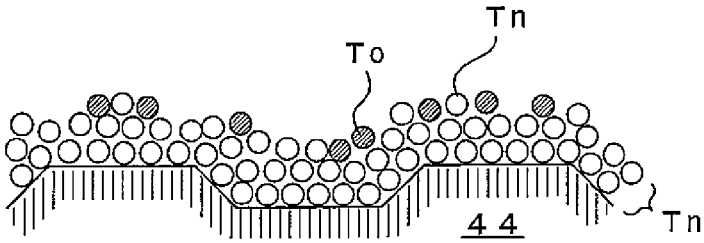

Meanwhile, depending upon the electrostatic force of the developing roller 44 and the charging characteristics of toner itself, two or more layers of new toner may be formed on the surface of the developing roller 44 as shown in FIG. 6D. In such an instance as well, new toner Tn and old toner To are mixed together in a layer far from the surface of the developing roller 44 and layer separation phenomenon occurs.

As described above, of toner layers formed on the surface of the developing roller 44, in an outer layer far from the developing roller 44, the rate of old toner To is higher. Old toner To only weakly adheres to the surface of the developing roller 44 or to a toner layer on this surface since it has a low charge level. As a result, old toner To falls off from the surface of the developing roller 44 and scatters inside the apparatus while being transported by the rotation of the developing roller 44. Further, toner charged to the polarity opposite to the intended polarity adheres to a region of an electrostatic latent image on the photosensitive member 22 to which toner is not supposed to adhere, and causes fog.

This model can explain the following experimental fact. For example, when a developer containing only a little remaining toner after being used over a long period of time was filled with new toner, the occurrence of toner scattering, fog and the like temporarily increases but gradually decreases thereafter. The reason of this appears to be that mixing of a great amount of new toner with degraded toner inside the developer resulted in dominant presence of new toner near the surface of the developing roller 44 and a large amount of old toner in the outer-most surface of a toner layer. It appears that during continued use, new toner would be selectively used, which would reduce a difference of the characteristics of new toner from those of old toner, relieve the layer separation phenomenon and eventually decrease the degree of toner scattering and the like.

This is backed by an experiment of replenishing toner of a different color from an original toner color. The surface of the developing roller 44 was observed after replenishing yellow toner in the cyan developer 4C inside of which a remaining toner amount was small, for instance. As a result, a toner layer of a greenish color resulted from mixing of cyan toner and yellow toner was formed on the surface of the developing roller. However, when the surface toner was removed with blown air, through brushing off or by otherwise appropriate method, the color of the surface of the developing roller 44 changed to yellow gradually. To be noted in particular, toner in the first layer directly contacting the surface of the developing roller 44 had a yellow color which was almost the same as the original color of the yellow toner. On the other hand, when the image forming operation was executed using this developer, it was primarily cyan toner that was scattered around the developer or caused fog on the photosensitive member 22.

From these results, it turns out that layer separation phenomenon occurs in which a layer near the surface of the developing roller 44 is dominated by new toner, whereas a layer far from the surface contains a large amount of old toner, and that it is principally old toner that causes toner scattering and the like.

Meanwhile, the terms "new toner" and "old toner" used herein express a concept regarding relative differences in terms of characteristics among toner particles inside the developer, and therefore, are not necessarily relevant to whether toner itself is fresh or not. For example, even fresh toner may contain some amount of toner whose characteristics are inadequate like old toner described above, in which case such toner would act like "old toner". Further, even toner which is not fresh toner can be considered to be "new toner" if relative differences in terms of characteristics among toner particles are small.

A similar phenomenon could occur even when the developers do not have slots for replenishing toner, not to mention when the developers have such slots. In the case where the developer is partitioned into two or more chambers and toner is fed from one chamber to other chamber at a certain timing as in the embodiment for example, new toner gets mixed with old toner at a timing of feeding of toner from one chamber to other chamber. Although no auger is provided inside the developers in this embodiment, when the developer 4K, . . . rotates in accordance with rotation of the rotary developer unit 4, new toner stored in the first chamber 411 flows into the second chamber 412 which contains old toner at an increased ratio and gets mixed with the old toner. This remains unchanged in a structure where a toner transportation mechanism such as an auger is disposed inside a developer, and a structure where toner is replenished regularly from a toner tank which is disposed separately from a developer.

Figure 7:
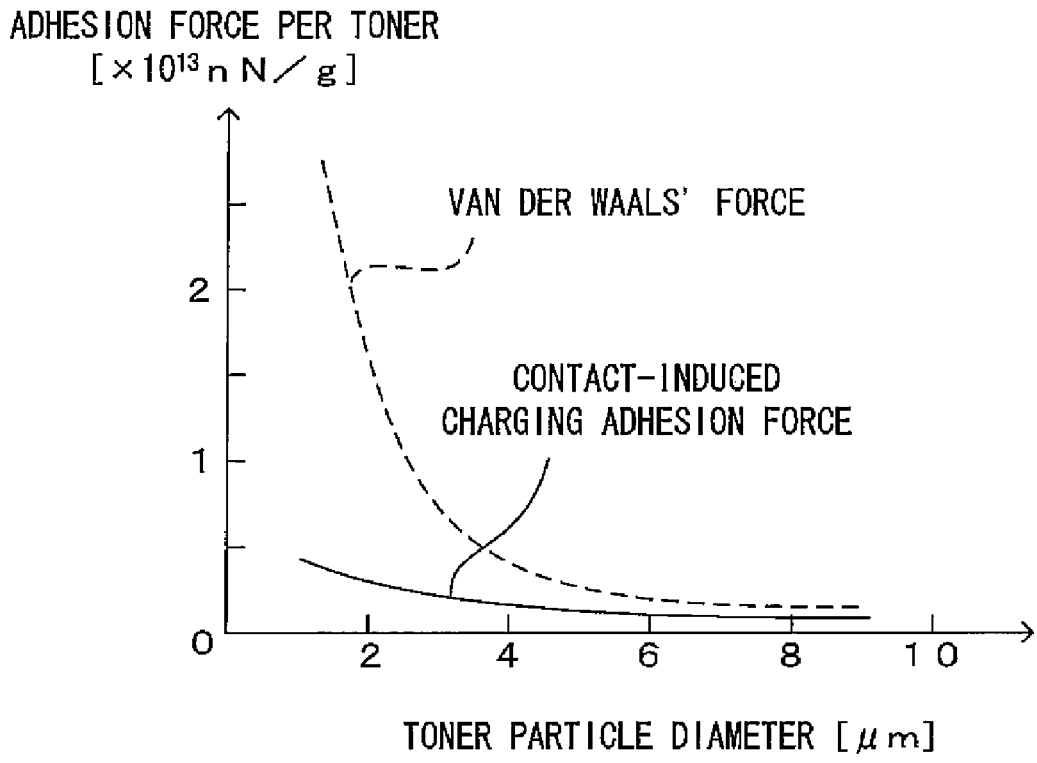
FIG. 7 is a graph showing a relationship between a toner particle diameter and adhesion force to the developing roller.

FIG. 7 is a graph showing a relationship between a toner particle diameter and adhesion force to the developing roller. Among force acting to make toner particles adhere to the surface of the developing roller 44 or a toner layer on this surface are principally contact-induced charging adhesion force which is electrostatic attraction force acting upon charged toner, and van der Waals' force. As shown in FIG. 7, when a toner particle diameter is large, there is not a remarkable difference between contact-induced charging adhesion force and van der Waals' force. On the contrary, when a toner particle diameter is small, and particularly when the toner particle diameter is equal to or less than 5 μm, van der Waals' force is dominant. Toner particles stick to each other more easily as van der Waals' force becomes stronger.

The layer separation phenomenon described above is a notable problem where toner having a small particle diameter is used upon which van der Waals' force acts strongly. When van der Waals' force is weak, toner would adhere to the surface of the developing roller 44 mainly because of electrostatic attraction force, and therefore, old toner having a low charge level would not gather at the surface of the developing roller 44. In contrast, when the action of van der Waals' force is strong, further toner would adhere to a toner layer on the developing roller 44 regardless of the charge level of the further toner. Such toner inevitably contains a large amount of old toner, thereby giving rise to layer separation phenomenon described above. In addition, old toner would easily clump together due to van der Waals, force and form a large toner block. Having a low charge level despite its particle diameter, such a toner block tends to fall off from the surface of the developing roller 44 and cause toner scattering and the like. It then follows that a problem attributable to layer separation phenomenon is particularly remarkable when toner T to use has a small particle diameter.

Consequently, in this embodiment, it is constructed such that the convex sections 441 within the surface of the developing roller 44 do not carry toner but the concave section 442 alone carries a thin and uniform layer of new toner. The reason for not permitting the convex sections 441 to carry toner is as follows. If the convex sections 441 carry toner, the toner may clump together due to pressurization by the restriction blade 46 in a restriction nip and may fixedly adhere to the surface of the developing roller 44, thereby causing filming, or a block of thus clumped toner may get scattered to outside the developer. This is noticeable when the convex sections 441 carry old toner and particularly remarkable when the toner T is small-diameter toner having a volume average particle diameter of 5 μm or less. To avoid this problem, the restriction blade 46 scrapes off toner which is carried by the convex sections 441 within the surface of the developing roller 44.

Further, carrying of toner only by the concave section 442 achieves the following effect. Toner carried by the concave section 442 is free from the pressure from or friction with the restriction blade 46, and hence, is less likely to clump together or deteriorate. This is advantageous in maintaining toner characteristics such as the charge level and the fluidity in mint condition for a long time. Production of "old toner" having deteriorated characteristics is suppressed, and hence, toner scattering and the like can be further suppressed.

Figure 8A:
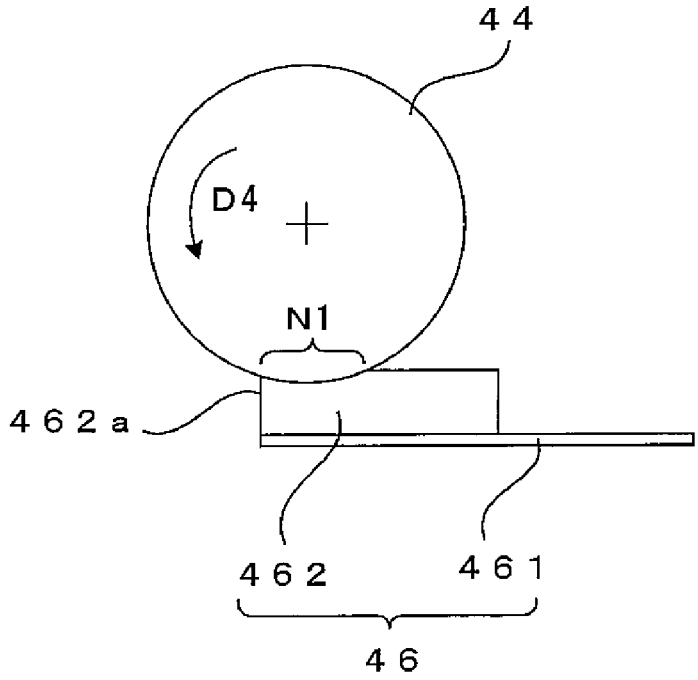
FIGS. 8A and 8B are diagrams showing a condition of the developing roller and the restriction blade abutting on each other.
Figure 8B:
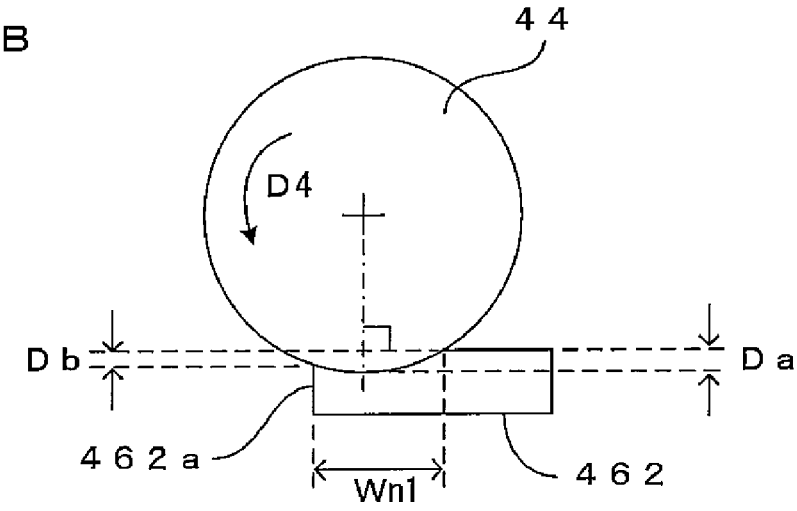

FIGS. 8A and 8B are diagrams showing a condition of the developing roller and the restriction blade abutting on each other. In this embodiment, as shown in FIG. 8A, the restriction blade 46 abuts on the surface of the developing roller 44 in a direction against the rotation direction D4 of the developing roller 44. The elastic member 462 at the tip end of the restriction blade 46 gets pressed by the surface of the developing roller 44 and partially and elastically deformed, whereby a restriction nip N1 is formed in which the surface of the developing roller 44 contacts the elastic member 462. Further, an upper edge of an upstream-side end 462*a* of the elastic member 462 in the rotation direction D4 of the developing roller 44 is within the restriction nip N1, and toner is regulated by means of the edge restriction.

As shown in FIG. 8B, the upstream-side end 462*a* of the elastic member 462 is located on the upstream side in the rotation direction D4 of the developing roller 44 relative to a perpendicular from the rotation center of the developing roller 44 to the top surface of the elastic member 462. Hence, the deformation Db of the elastic member 462 owing to elastic deformation in the vicinity of the upstream-side end 462*a* is somewhat smaller than the maximum deformation Da of the elastic member 462 in the vicinity of the foot of the perpendicular. The elastic member 462, positioned like this, contacts the developing roller 44 in a wide area within the top surface of the elastic member 462, which makes a restriction nip width Wn1 relatively wide.

Figure 9:
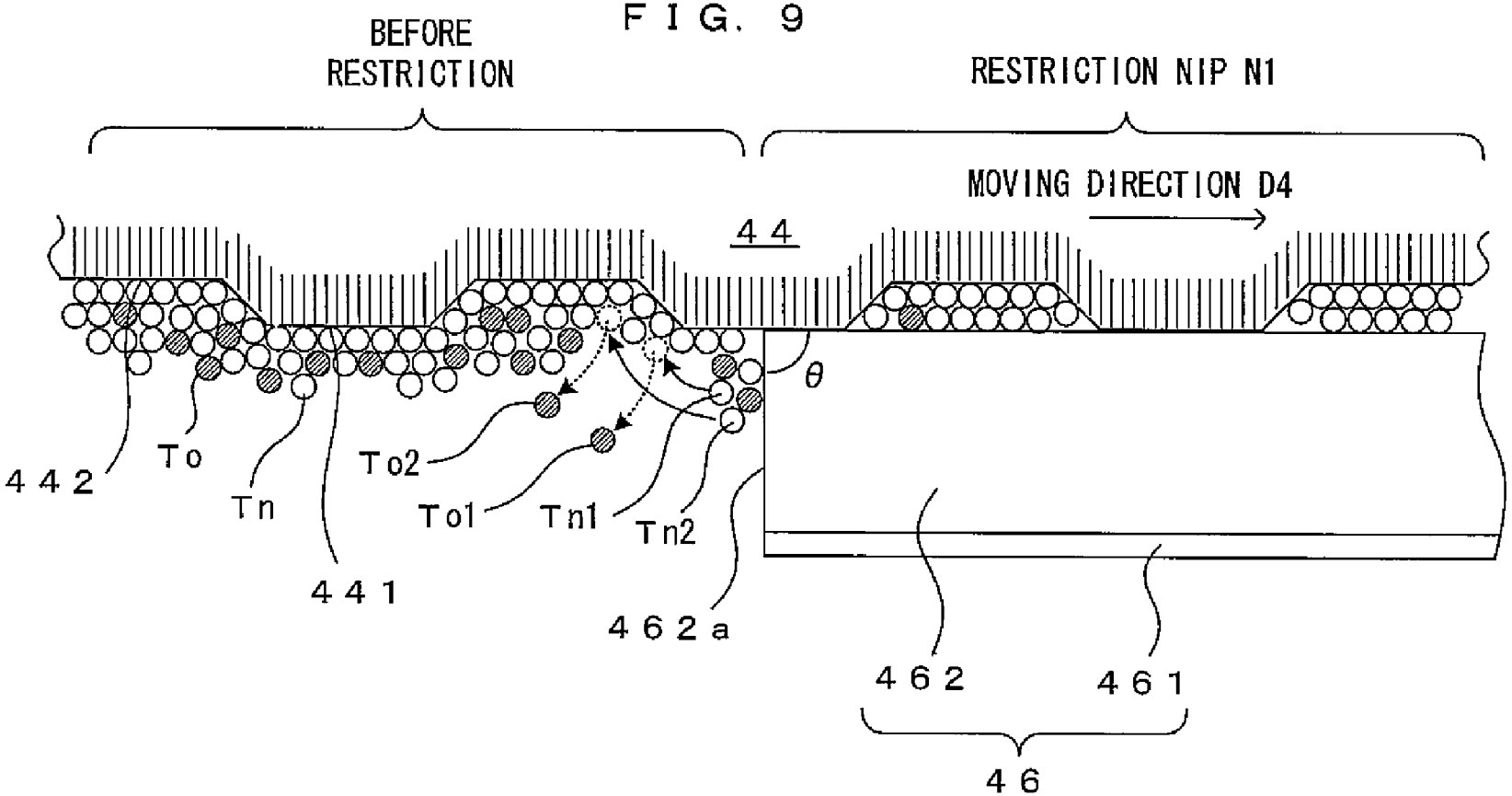
FIG. 9 is an enlarged diagram schematically showing the restriction nip in this embodiment.

FIG. 9 is an enlarged diagram schematically showing the restriction nip in this embodiment. A layer of new toner Tn denoted at the white circles is formed right below the surface of the developing roller 44 within an upstream-side region labeled as "BEFORE RESTRICTION" with respect to the restriction nip N1 in the moving direction D4 of the surface of the developing roller 44, whereas a layer in which new toner Tn and old toner To denoted at the shaded circles are mixed is formed on the surface of this toner layer. On the other hand, in the restriction nip N1, the elastic member 462 of the restriction blade 46 is pressed against the surface of the developing roller 44, and more particularly, against the convex sections 441 within the surface of the developing roller 44. Hence, toner which the convex sections 441 used to carry before restriction is scraped off by the upstream-side end 462*a* of the elastic member 462 regardless of whether the toner is new or old.

While toner thus scraped off from above the convex sections 441 contains both new and old toner, toner removed from near the surfaces of the convex sections 441 has a particularly high charge level. This is because toner which used to adhere to the surfaces of the convex sections 441 is almost entirely new toner which exhibits an excellent charging characteristic and its charge level increases due to friction with and rolling by the restriction blade 46 during removal from the convex sections 441, and therefore, strong electrostatic force which attracts the toner toward the developing roller 44 acts upon this toner. Meanwhile, on the upstream in the moving direction D4 of the abutting position with the restriction blade 46 (that is, on the left-hand side in FIG. 9), old toner having a low charge level as well is present. When the toner scraped off from near the convex sections 441 and having a high charge level collides with such old toner, new toner Tn1 and Tn2 having high charge levels flip old toner To1 and To2 on the upstream side having low charge levels. The old toner present in the vicinity of the surface of the developing roller 44 is gradually replaced with the new toner Tn and is driven away toward the upstream side. As a result, within the restriction nip N1 and on the downstream side to the restriction nip N1 in the rotation direction D4 of the developing roller 44, the concave section 442 alone carries toner and this toner contains the old toner at an extremely low rate.

To facilitate this phenomenon, the edge surface of the upstream-side end 462*a* of the elastic member 462 is preferably an upright wall which is approximately perpendicular to the surface of the developing roller 44. When the angle θ of the edge of the elastic member 462 is an acute angle, toner which has been scraped off is pulled away from the surface of the developing roller 44, and therefore, replacement of old toner with new toner described above will not occur easily Meanwhile, when the angle θ is an obtuse angle, toner which has been scraped off is pushed into the restriction nip N1 and pressed there. When the angle θ is around 90 degrees, toner which has been scraped off stays near the upstream-side end 462*a* of the elastic member 462, promoting toner replacement.

Figure 10:
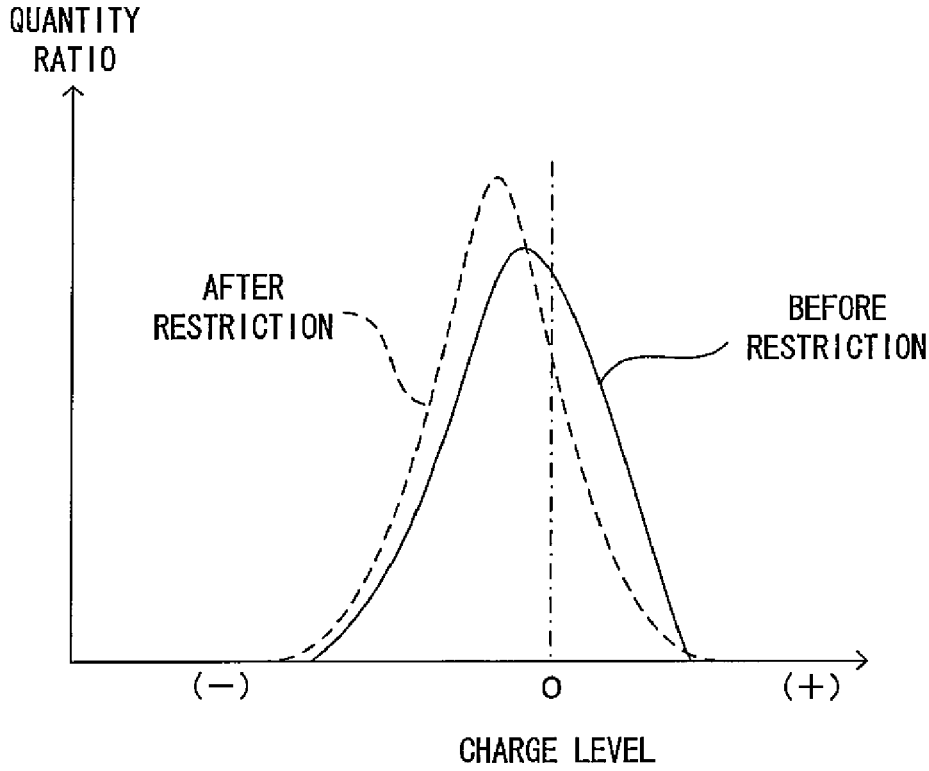
FIG. 10 is a graph showing a distribution of the charge level of toner measured before and after restriction.

FIG. 10 is a graph showing a distribution of the charge level of toner measured before and after restriction. When the quantity ratio of toner collected from the surface of the developing roller 44 before restriction by the restriction blade 46 is plotted against a charge level, the distribution curve is relatively broad, and the toner sample contains electrically neutral toner and positively charged toner each at a high ratio as denoted by the solid line in FIG. 10. As for toner collected from the surface of the developing roller 44 in and after the restriction nip N1, as denoted by the dotted line in FIG. 10, the distribution curve is sharp, and the ratio of positively charged toner is dramatically low. This result shows that through toner restriction according to this embodiment, a toner layer after restriction is formed by favorably charged toner. When thus restricted toner layer is transported to the opposed position facing the photosensitive member 22 and an electrostatic latent image is developed, an excellent image with little fog can be formed and scattering of old toner having a low charge level to outside the developer is suppressed.

Next, the height difference between the convex sections 441 and the concave section 442 within the surface of the developing roller 44 will be discussed. In this embodiment, toner on the convex sections 441 is removed by the contact with the restriction blade 46, and toner is carried only by the concave section 442. The amount of toner carried by the concave section 442 therefore determines the amount of toner transported to the opposed position facing the photosensitive member 22. The height difference is thus important in securing an excellent image quality.

Figure 11A:
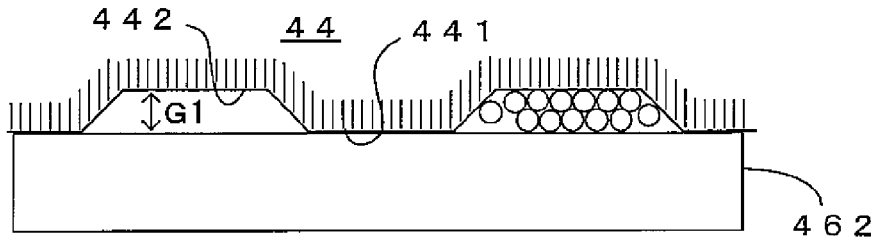
FIGS. 11A through 11C are diagrams schematically showing a relationship between carried toner and the height difference within the surface of the developing roller.
Figure 11B:
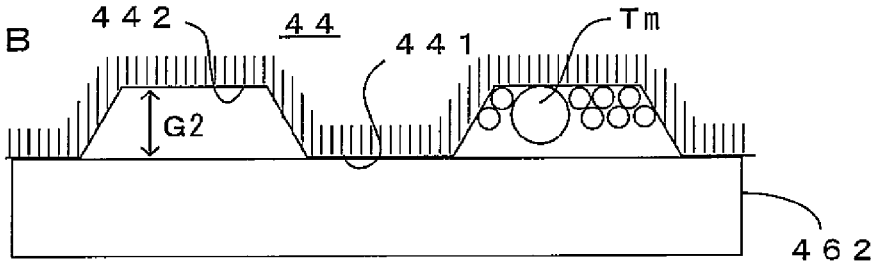
Figure 11C:
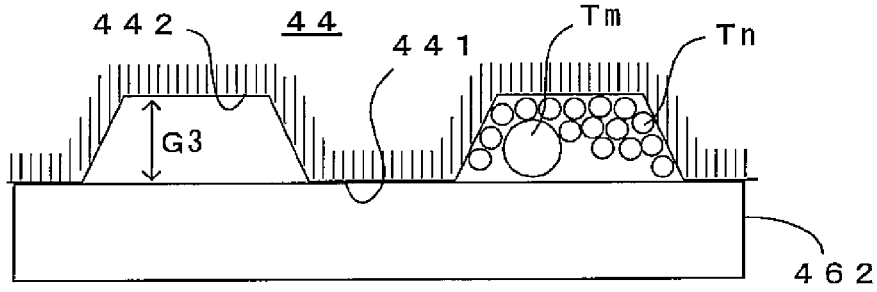

FIGS. 11A through 11C are diagrams schematically showing a relationship between carried toner and the height difference within the surface of the developing roller. In this embodiment, for the purpose of making the concave section 442 carry toner with the elastic member 462 abutting on the convex sections 441, the height difference between the convex sections 441 and the concave section 442, or more strictly speaking, the distance between the concave section 442 and the elastic member 462 needs be equal to or larger than the volume average particle diameter of toner. Describing this in more detail, in the event that the elastic member 462 does not get very large elastic deformation in the restriction nip N1 because the elastic member 462 is relatively hard, the size of the restriction nip N1 is relatively big or for other reason, the height difference between the convex sections 441 and the concave section 442 is almost the same as the distance between the concave section 442 and the elastic member 462. Any one of the two may therefore be utilized without causing a substantial problem. However, when the elastic member 462 shows large elastic deformation in the restriction nip N1 and the elastic member 462 widely swells toward the bottom of the concave section 442, it is preferable to focus attention on the distance between the concave section 442 and the elastic member 462 and to set this distance equal to or larger than the volume average particle diameter of toner. The volume average particle diameter of toner will be hereinafter denoted at "Dave". When the distance between the concave section 442 and the elastic member 462 has a value G1 which is twice the volume average particle diameter Dave of toner or larger as shown in FIG. 11A, the concave section 442 carries two or more layers of toner on the average.

The first layer of toner contacting the surface of the developing roller 44 adheres to the developing roller 44 with strong electrostatic force. However, electrostatic force acting upon toner in the second and farther layers adhering on the first toner layer is weaker than this electrostatic force, and therefore, the toner in the second and farther layers can easily go off from the developing roller 44 and play a major role for development of an electrostatic latent image at the opposed position facing the photosensitive member 22. In other words, with the second and farther toner layers formed in the concave section 442 in this manner, the development efficiency is better than where the concave section 442 carries only one toner layer. This is particularly effective where toner having a small particle diameter (for instance, a volume average particle diameter of 5 μm or less) is used whose adhesion among toner particles due to van der Waals' force is strong. The distance between the concave section 442 and the elastic member 462 is preferably twice the volume average particle diameter Dave of toner or larger. However, since old toner will get mixed in if the distance is too long, the distance should properly be triple the volume average particle diameter Dave of toner or less. In short, the distance should satisfy the following formula:

$$\text{Dave} \leqq G1 \leqq 3\ \text{Dave} \qquad \text{(Formula 1)}$$

This is particularly preferable with respect to toner among which a toner particle diameter does not vary greatly.

It is preferable that the concave section 442 within the surface of the developing roller 44 carry two or more toner layers so as to secure a sufficient development efficiency. That is, the following formula needs be satisfied:

$$2\ \text{Dave} \leqq G1 \qquad \text{(Formula 1a)}$$

In the meantime, considering variations of a toner particle diameter, the distance G2 between the concave section 442 and the elastic member 462 may be equal to or larger than the diameter of the largest toner particles Tm among toner T as shown in FIG. 11B. The maximum particle diameter of toner can be defined as described below in accordance with statistics. In other words, the maximum particle diameter Dm can be defined by the following formula:

$$Dm = D50 + 3\sigma \qquad \text{(Formula 2)}$$

where the symbol D50 denotes the 50% particle diameter at the quantity standard of toner T and the symbol σ denotes the geometrical standard deviation. In toner which is normally used, the proportion of toner whose particle diameter exceeds the maximum particle diameter Dm is extremely small.

When the distance between the concave section 442 and the elastic member 462 is small, toner having a large particle diameter trapped in the concave section 442 gets pressed by the elastic member 462 and deteriorates. In addition, toner having other large particle diameter could stay indefinitely within the developer without getting fed to the concave section 442 so that the particle diameter distribution of toner will gradually shift toward the large diameter side to the extent not usable for development. When the distance between the concave section 442 and the elastic member 462 is equal to or larger than the maximum particle diameter Dm as described above, the concave section 442 can carry almost all toner particles contained in toner T held inside the developer, which makes it possible to use all toner inside the developer to the very end. That is, the following formula needs be satisfied:

$$G2 \geqq Dm = D50 + 3\sigma \quad \text{(Formula 3)}$$

Toner Tm having the maximum particle diameter may be made carried on the first toner layer which the concave section 442 carries as shown in FIG. 11C. In short, the distance G3 between the concave section 442 and the elastic member 462 may be determined so as to satisfy the following formula:

$$G3 \geqq \text{Dave} + Dm = \text{Dave} + D50 + 3\sigma \quad \text{(Formula 4)}$$

Since this makes it possible to carry even such toner Tm which has the maximum particle diameter on top of a toner layer which is in contact with the developing roller 44, it is possible to use large-diameter toner efficiently for development.

As described above, in this embodiment, the restriction blade 46 scrapes off within the restriction nip N1 toner carried by the convex sections 441 within the surface of the developing roller 44 so that the concave section 442 alone carries toner. This suppresses pressurization of toner in the restriction nip N1 and hence clumping and degrading of toner. Since toner is prevented from degrading, it is possible to reduce scattering of toner to outside the developer from the developing roller 44 which is caused mainly by degraded toner. Further, the upstream-side edge surface of the restriction blade 462 is formed as an upright wall which is approximately perpendicular to the surface of the developing roller 44 and toner which has been scraped off stays at the wall. Accordingly, old toner trapped inside the concave section 442 is replaced with new toner, thereby lowering the proportion of old toner contained in a toner layer. This reduces the amount of old toner which is transported to outside the developer and further improves the effect of suppressing toner scattering, fog, etc.

Next, an image forming apparatus of a second embodiment according to the invention will now be described. In the apparatus of the second embodiment, the restriction blade 46 abuts on the developing roller 44 in a different fashion from the first embodiment. Structures and operations other than this are the same as those in the first embodiment. Structures common between the first and the second embodiments will not be described but will be simply denoted at the same reference symbols, and differences of the second embodiment from the first embodiment will be described in principle.

Figure 12A:
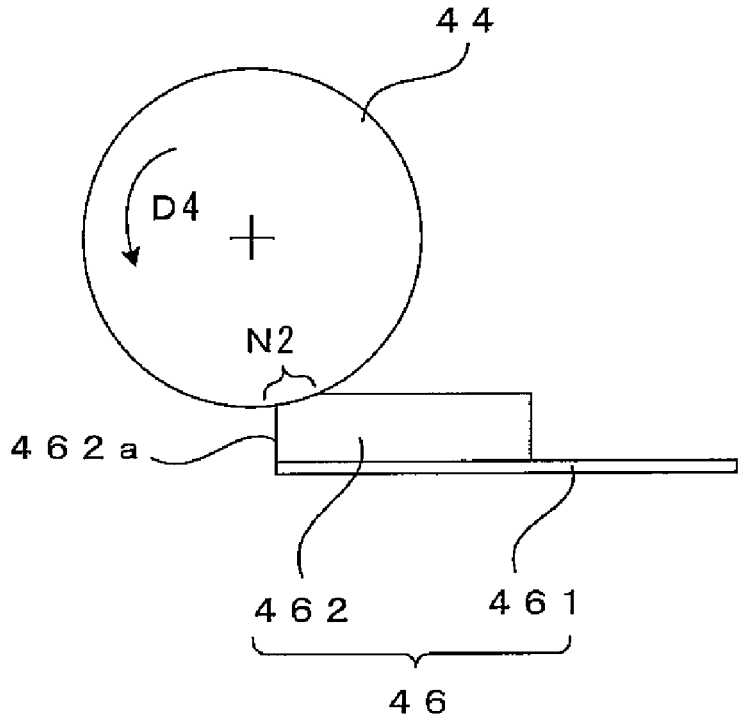
FIGS. 12A and 12B are diagrams showing a condition of the developing roller and the restriction blade abutting on each other in the second embodiment.
Figure 12B:
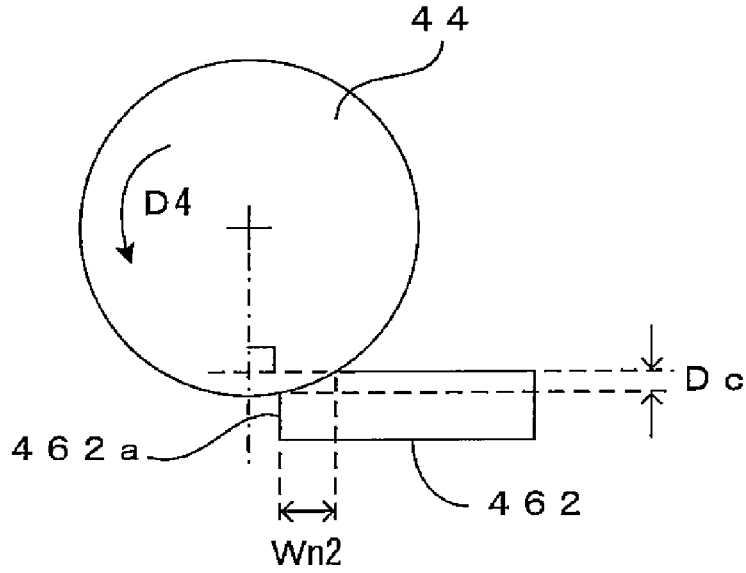

FIGS. 12A and 12B are diagrams showing a condition of the developing roller and the restriction blade abutting on each other in the second embodiment. As shown in FIG. 12A, in the second embodiment as well, the restriction blade 46 abuts on the surface of the developing roller 44 in a direction against the rotation direction of the developing roller, and accordingly a restriction nip N2 is formed. As shown in FIG. 12B however, the upstream-side end 462*a* of the elastic member 462 is located on the downstream side in the rotation direction D4 of the developing roller 44 relative to a perpendicular from the rotation center of the developing roller 44 to the top surface of the elastic member 462. The deformation of the elastic member 462 owing to elastic deformation therefore has a maximum value Dc at the upstream-side end 462*a*. In other words, the elastic member 462 is elastically deformed most significantly at its upstream-side end. Further, the elastic member 462 contacts the developing roller 44 in only a small area, which makes a restriction nip width Wn2 narrower than the restriction nip width Wn1 which the first embodiment provides.

Figure 13:
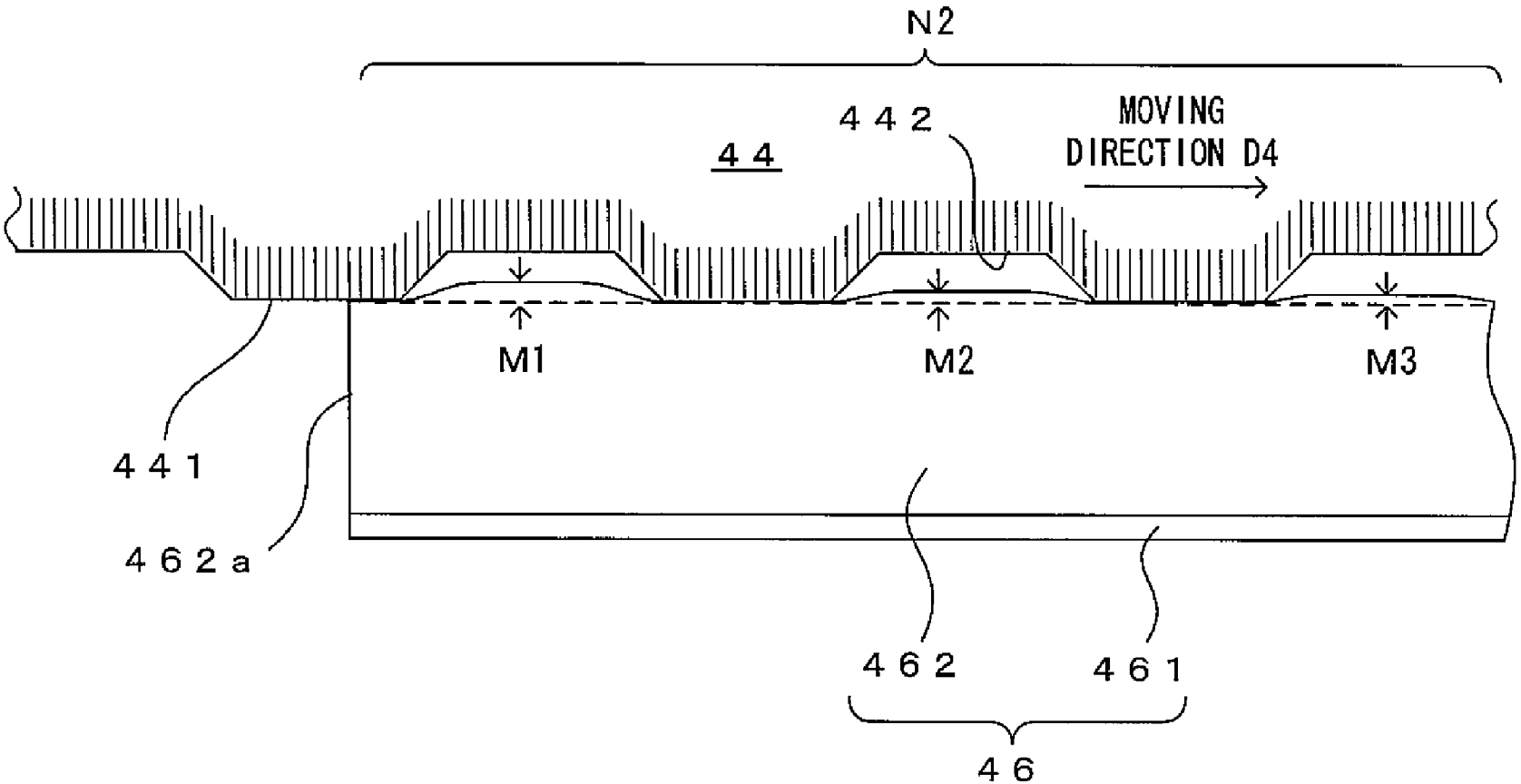
FIG. 13 is an enlarged diagram schematically showing the restriction nip in this embodiment.

FIG. 13 is an enlarged diagram schematically showing the restriction nip in this embodiment. Since the elastic member 462 is elastically deformed most significantly at its upstream-side end as described above, in the vicinity of the upstream-side end of the restriction nip N2, the greatest abutting pressure acts upon sections of the elastic member 462 which are opposed against the convex sections 441 of the developing roller 44. On the contrary, sections opposed against the concave section 442 of the developing roller 44 are not exposed to any pressure. Due to this, the sections of the elastic member 462 opposed against the concave section 442 bend toward the bottom of the concave section 442 (toward above in FIG. 13) and the surface of the elastic member 462 swells up in the spaces facing the concave section 442 as shown in FIG. 13. The amount of the bending becomes greatest at the upstream-side end of the restriction nip N2 which is under the largest abutting pressure but decreases with a distance toward the downstream side. In short, the following relationship holds true:

$$M1 > M2 > M3 \quad \text{(Formula 5)}$$

This relationship holds true also when there is only one concave section 442 which is enclosed within the restriction nip, and the amount of the bending decreases with a distance toward the downstream side even within one concave section 442.

The elastic member 462 bulging toward the concave section 442 allows transportation of a toner layer whose thickness corresponds to the distance between the front edge of the elastic member 462 and the bottom of the concave section 442 from among a plurality of toner layers carried by the concave section but blocks the other toner layers. However, the amount of the bending decreases toward the downstream side in the rotation direction D4 of the developing roller 44 as described above. Hence, the pressure applied upon toner will not rise within the restriction nip and toner will not fixedly adhere to the bottom of the concave section 442. In addition, although a toner layer arriving at the restriction nip may get pressurized as it further proceeds toward the downstream side, and deformation and fixing of toner to each other may occur when the distance between the front edge of the elastic member 462 and the bottom of the concave section 442 is longer than on the downstream side, the structure above avoids this problem.

With such a structure as well, since the restriction blade 46 removes toner on the convex sections 441, it is possible to prevent degradation of toner due to pressing like in the first embodiment described earlier. It is also possible to replace old toner in the concave section 442 with new toner and to reduce the amount of old toner which is transported to outside the developer. Therefore, the apparatus in the second embodiment as well is capable of suppressing toner scattering, fog and the like as in the first embodiment. Further, the consideration upon the height difference between the convex sections 441 and the concave section 442 provided in the first embodiment is valid for this embodiment as well.

As described above, in the embodiments above, the developer 4K, . . . correspond to the "developer apparatus" of the invention. The housing 41, the developing roller 44 and the restriction blade 46 function respectively as the "container", the "toner carrier roller" and the "restriction member" of the invention. The elastic member 462 attached to the restriction blade 46 functions as the "elastic abutting member" of the invention. Further, in the embodiments above, the first chamber 411 and the second chamber 412 within the developer 4K, . . . correspond to the "toner storage chamber", and the rotary developer unit 4 which rotates the entire developer and accordingly feeds toner inside the first chamber to the second chamber functions as the "toner transportation mechanism" of the invention. In addition, in the image forming apparatuses in the embodiments above, the photosensitive member 22 and the developer 4K, . . . function respectively as the "image carrier" and the "developer".

It should be noted that the invention is not limited to the embodiments above, but may be modified in various manners in addition to the embodiments above, to the extent not deviating from the object of the invention. For example, although the convex sections 441 of the developing roller 44 are lozenge-shaped in the above embodiments, this is not limiting. The convex sections may be shaped differently such as circles and triangles for instance.

Although the developing roller 44 is metallic cylinder in the above embodiments, the invention is also applicable to an apparatus comprising a developing roller made of other material. However, experiments performed by the inventors of the invention have identified that layer separation phenomenon described above would be remarkable when a developing roller whose surface is made of a conductive material such as a metallic developing roller and a developing roller made of non-metal with metal-plating thereon is used. Hence, the invention would be very effective when applied to an apparatus comprising a developing roller which has such a conductive surface. In this respect, the invention is also effective to an apparatus comprising a developing roller which is made conductive by dispersing a conductive material such as carbon black and metallic fine powder in a cylinder made of rubber, resin or the like for instance.

Further, although the restriction blade 46 is prepared by attaching the elastic member 462 made of resin to a plate-like member 461 made of metal in the embodiment above, this structure is not limiting. The restriction blade may be a metal plate coated with elastic resin, for example. In addition, an appropriate bias potential may be applied to the restriction blade.

Although toner used in the embodiments above is not particularly limited, the effect of the invention is remarkable when monocomponent toner whose change in charging characteristics with time is relatively great is used. Further, application of the invention to an apparatus which uses toner whose average particle diameter is small is effective since such toner gives rise to a serious problem of toner scattering and the like. From the viewpoint of improving the resolution of an image and reducing toner consumption, demand for toner having a smaller particle diameter has been increased in recent years, and fine powder toner having a volume average particle diameter of 5 μm or less has come to be manufactured. While such fine powder toner easily causes toner scattering and the like, those problems can be solved by applying the invention.

The effect of the invention is particularly remarkable for use of toner in which the particle diameter of an additive added to the toner is 50 nm or less and a coverage factor of the additive on a surface of the toner particle is 100% or more. Such toner containing an additive has a tendency that its fluidity is high initially but changes greatly with time and becomes significantly low during use over a long period of time. Application of the invention to such toner is effective since such toner easily causes layer separation phenomenon due to a difference in fluidity between new toner and old toner.

The image forming apparatus in the above embodiment is a color image forming apparatus in which the developers 4K, . . . are attached to the rotary developer unit 4 and toner inside the developers is mixed when the developers 4K, . . . rotate. However, the application of the invention is not limited to this as mentioned earlier. The invention is also applicable to a monochromatic image forming apparatus which includes only one developer and forms a monochromatic image for example. Particularly, the invention is favorably applied to an apparatus which is capable of replenishing toner by a user or an operator through a replenishing slot which is provided in the developer, and to an apparatus which is structured that toner is regularly replenished from a toner tank and the like separately provided from the developer In an embodiment according to the invention, for instance, a height difference between the convex sections and the concave section may be equal to or larger than a volume average particle diameter of toner, the restriction member may include an elastic abutting member which is formed by an elastic material, is pressed against the surface of the toner carrier roller to form the restriction nip, and an upstream-side end of the elastic abutting member in the rotation direction of the toner carrier roller may abut on the convex sections of the toner carrier roller to scrape off toner on the convex sections.

In this structure, the concave section can carry one toner layer or more while the elastic abutting member scrapes off toner on the convex sections. Of toner thus scraped off, highly charged toner pushes out old toner which is carried by the toner carrier roller at an upstream side of the restriction nip in the rotation direction of the toner carrier roller. Due to this effect, at a downstream side of the restriction nip, the concave section alone carries toner, which contains only a small proportion of old toner, thereby suppressing toner scattering, fog and the like. Here, it is preferable that the top surfaces of the convex sections form a part of the same cylindrical surface, that is, the enveloping surface formed by the top surfaces of the convex sections is one cylindrical surface. With such a structure, since the toner carrier roller can be regarded as a rotating cylinder in broad perspective, it is possible to maintain the abutting pressure of this cylinder on the restriction member constant in the circumferential direction of the cylinder. Further, the top surfaces of the respective convex sections may be flat.

In this structure, it is desirable that an upstream-side edge surface of the elastic abutting member in the rotation direction of the toner carrier roller is upright approximately perpendicularly to the surface of the toner carrier roller. This prevents toner adhering to the convex sections from getting dragged into the restriction nip and pressed to clump together by the elastic abutting member or fixed to the surface of the toner carrier roller. Further, toner which the elastic abutting member has scraped off from the surface of the toner carrier roller stays near the upstream-side edge surface of the elastic abutting member, and hence, replacement of old toner with new toner within the surface of the toner carrier roller is promoted. Therefore, a ratio of old toner remaining on the surface of the toner carrier roller after restriction can be further reduced.

Here, a distance between the elastic abutting member and the concave section in the restriction nip may be the same as the volume average particle diameter of toner through triple the volume average particle diameter of toner. When the distance between the elastic abutting member and the concave section in the restriction nip is equal to or larger than the volume average particle diameter of toner, it is possible for the concave section to carry one toner layer without fail. Meanwhile, if the distance between the elastic abutting member and the concave section is excessively large, the concave section carries a great amount of toner and the amount of old toner contained in this toner is large. Consequently, the distance between the elastic abutting member and the concave section may, for instance, be up to triple the volume average particle diameter of toner, thereby properly limiting the amount of toner which the concave section carries.

Alternatively, a distance between the elastic abutting member and the concave section in the restriction nip may be equal to or larger than a maximum particle diameter of toner. For example, the maximum particle diameter of toner can be defined as a value which is calculated by adding triple the geometrical standard deviation to the 50% particle diameter at the quantity standard in a toner particle diameter distribution. This is because a particle diameter variation is small in currently manufactured toner and the ratio of toner particles whose particle diameters exceed this value is extremely low in toner which is commercially available today. This structure makes it possible for the toner carrier roller to carry almost all new toner which is housed in the container, and hence, prevents retention of large-diameter toner within the container.

For instance, the distance between the elastic abutting member and the concave section in the restriction nip may be equal to or larger than a sum of the volume average particle diameter of toner and the maximum particle diameter of toner. This makes it possible to carry one toner layer on the surface of the concave section and further carry toner particles whose diameters are the largest, and hence, prevents a problem that the elastic abutting member presses large-diameter toner trapped in the concave section and this toner gets degraded or aggregated. In addition, it is possible to make the large-diameter toner efficiently contribute to development.

Further, a deformation amount (or deformation volume) of the elastic abutting member which abuts on the toner carrier roller and gets elastically deformed is preferably the greatest at the upstream-side end of the elastic abutting member in the rotation direction of the toner carrier roller. The elastic abutting member abuts on the surface of the toner carrier roller under pressure, and hence, the elastic abutting member gets elastically deformed. Describing this in more detail, the elastic abutting member is pressed against the surfaces of the convex sections and thus pressed sections elastically bend, and hence, the thickness of the elastic abutting member reduces in a direction orthogonal to the surface of the toner carrier roller The "deformation volume of the elastic abutting member" in the invention is indicative of this reduction of the thickness. In microscopic perspective, the amount of shrinkage of the elastic abutting member at a section of the elastic abutting member opposed against the concave section of the toner carrier roller is smaller than the amount of shrinkage at sections pressed against the convex sections. In short, in the space above the concave section, the surface of the elastic abutting member bends toward the bottom of the concave section. The elastic abutting member bending in this manner presses toner which is carried by the concave section. The amount of bending of the elastic abutting member in the space above the concave section is considered to increase as the deformation volume of the elastic abutting member taken in broad perspective increases. Further, the larger the deformation volume of the elastic abutting member is, the greater the abutting pressure upon the convex sections is.

Here, with the deformation volume of the elastic abutting member reaching its maximum at the upstream-side end of the elastic abutting member in the rotation direction of the toner carrier roller as described above, the abutting pressure upon the convex sections becomes greatest at the upstream-side end of the restriction nip, which makes it possible to remove toner from the convex sections even more securely. In addition, since the amount of bending of the elastic abutting member toward the concave section decreases within the restriction nip with a distance to the downstream side, the pressure upon toner carried by the concave section becomes weaker on the downstream side within the restriction nip. Hence, it is possible to prevent unwanted pressure from applying upon toner.

In the respective developer apparatuses described above, the surface of the toner carrier roller may be made of a conductive material. According to experiments performed by the inventors of the invention, the layer separation phenomenon above, namely, the phenomenon that a layer mainly containing new toner and a layer mainly containing old toner are layered one atop the other on the surface of the toner carrier roller is particularly obvious when the surface of the toner carrier roller is made of a conductive material. Application of the concept of the invention to a developer apparatus having such a structure would be more effective.

The effect of the invention is also remarkable when the container includes a slot for replenishing toner from outside. A developer apparatus having such a structure could give rise to a phenomenon that a great amount of new toner is introduced through the slot upon old toner which has been used for long time and is stored inside the container. The above layer separation phenomenon would easily occur in such an instance, thereby causing toner scattering, fog, and the like. Application of the concept of the invention to a developer apparatus having such a structure would suppress toner scattering, fog and the like.

This remains unchanged in a structure which comprises a toner transportation mechanism, wherein the container includes a plurality of toner storage chambers which store toner, the surface of the toner carrier roller is at least partially exposed inside one of the toner storage chambers, and the toner transportation mechanism transports toner housed in other toner storage chamber to the one toner storage chamber. This is because new toner is fed onto old toner which is present near the toner carrier roller from other toner storage chamber in this structure as well.

Further, the invention is significantly effective where toner whose volume average particle diameter is 5 μm or less is used or where such toner is used in which the particle diameter of an additive added to the toner for the purpose of improving the fluidity of the toner is 50 nm or less and the coverage (or coverage factor) of the additive on a surface of toner particles is 100% or higher. When the volume average particle diameter of toner is 5 μm or less for instance, van der Waals' force among toner particles intensifies, and therefore, it is easy for old toner to adhere to a toner layer which is on the toner carrier roller. Since old toner tends to get scattered or cause fog even in this situation, the effect of the invention is great. Further, since the fluidity of toner to which such an additive has been added significantly changes with time and layer separation phenomenon would easily occur in the toner, application of the invention is very effective.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A developer apparatus, comprising:

a container which houses toner;

a toner carrier roller that is provided, on a surface thereof with a plurality of convex sections which are regularly arranged and a concave section which surrounds the convex sections, and rotates while carrying a toner layer of charged toner supplied from the container on the surface thereof; and a restriction member that abuts on the surface of the toner carrier roller to form a restriction nip, restricts a thickness of the toner layer carried on the surface of the toner carrier roller in the restriction nip, and removes the toner layer on the convex sections from among the toner layer carried on the surface of the toner carrier roller at an upstream-side end of the restriction nip in a rotation direction of the toner carrier roller such that the concave section alone carries toner.

2. The developer apparatus of claim 1, wherein a height difference between the convex sections and the concave section is equal to or larger than a volume average particle diameter of toner, the restriction member includes an elastic abutting member which is formed by an elastic material, is pressed against the surface of the toner carrier roller to form the restriction nip, and an upstream-side end of the elastic abutting member in the rotation direction of the toner carrier roller abuts on the convex sections of the toner carrier roller to scrape off toner on the convex sections.

3. The developer apparatus of claim 2, wherein the convex sections are so constructed and arranged that top surfaces of the convex sections coincide with a part of a curved surface of a single cylinder.

4. The developer apparatus of claim 2, wherein top surfaces of the convex sections are flat.

5. The developer apparatus of claim 2, wherein an upstream-side edge surface of the elastic abutting member in the rotation direction of the toner carrier roller is upright approximately perpendicularly to the surface of the toner carrier roller.

6. The developer apparatus of claim 2, wherein a distance between the elastic abutting member and the concave section within the restriction nip is not smaller than the volume average particle diameter of toner and not larger than triple the volume average particle diameter of toner.

7. The developer apparatus of claim 2, wherein a distance between the elastic abutting member and the concave section within the restriction nip is equal to or larger than a maximum particle diameter of toner.

8. The developer apparatus of claim 7, wherein the distance between the elastic abutting member and the concave section within the restriction nip is equal to or larger than a sum of the volume average particle diameter and the maximum particle diameter of toner.

9. The developer apparatus of claim 2, wherein a deformation volume of the elastic abutting member which gets elastically deformed when abutting on the toner carrier roller becomes greatest at the upstream-side end of the elastic abutting member in the rotation direction of the toner carrier roller.

10. A developer apparatus, comprising:

a container which houses toner;

a toner carrier roller that is provided, on a surface thereof, with a plurality of convex sections which are regularly arranged and a concave section which surrounds the convex sections, and rotates while carrying a toner layer of charged toner supplied from the container on the surface thereof, a height difference between the convex sections and the concave section being equal to or larger than twice a volume average particle diameter of toner; and a restriction member which abuts on the surface of the toner carrier roller to remove a toner layer on the convex sections from among the toner layer carried on the surface of the toner carrier roller such that the concave section alone carries toner.

11. The developer apparatus of claim 1, wherein the surface of the toner carrier roller is made of a conductive material.

12. The developer apparatus of claim 1, comprising a toner transportation mechanism, wherein the container includes a plurality of toner storage chambers which store toner, the surface of the toner carrier roller is at least partially exposed inside one of the toner storage chambers, and the toner transportation mechanism transports toner to the one toner storage chamber from other toner storage chamber.

13. The developer apparatus of claim 1, wherein a volume average particle diameter of toner is 5 μm or smaller.

14. The developer apparatus of claim 1, wherein the toner includes an additive whose particle diameter is 50 nm or less in addition to a toner particle, and a rate of an area of a surface of the toner particle covered with the additive to a surface area of the toner particle is 100% or more.

15. An image forming apparatus, comprising:

an image carrier that carries an electrostatic latent image; and a developer that includes a toner carrier roller which is provided, on a surface thereof, with a plurality of convex sections which are regularly arranged and a concave section which surrounds the convex sections, and carries a toner layer of charged toner on the surface thereof, the developer developing the electrostatic latent image carried by the image carrier with the toner, wherein within the surface of the toner carrier roller, after the convex sections and the concave section have carried the toner layer, a restriction member abutting on the surface of the toner carrier roller removes the toner layer on the convex section such that the concave section alone carries toner.

16. An image forming apparatus, comprising:

an image carrier that carries an electrostatic latent image; and a developer that includes a toner carrier roller and a restriction member, and develops the electrostatic latent image carried by the image carrier with toner, the toner carrier roller being provided, on a surface thereof, with a plurality of convex sections which are regularly arranged and a concave section which surrounds the convex sections, and carrying a toner layer of charged toner on the surface thereof, the restriction member abutting on the surface of the toner carrier roller to remove a toner layer on the convex sections from among the toner layer carried on the surface of the toner carrier roller such that the concave section alone carries toner, a height difference between the convex sections and the concave section being equal to or larger than twice a volume average particle diameter of toner.

17. A developing method, comprising:

arranging a toner carrier roller opposed to an image carrier which carries an electrostatic latent image, the toner carrier roller being provided, on a surface thereof, with a plurality of convex sections which are regularly arranged and a concave section which surrounds the convex sections, and carrying a toner layer of charged toner on the surface thereof;

developing the electrostatic latent image with the toner;

causing the convex sections and the concave section within the surface of the toner carrier roller to carry the toner layer before the arranging the toner carrier roller carrying the toner layer opposed to the image carrier; and removing the toner layer on the convex sections by means of a restriction member abutting on the surface of the toner carrier roller such that the concave section alone carries toner.

* * * * *